US008245433B1

(12) United States Patent
Smith

(10) Patent No.: US 8,245,433 B1
(45) Date of Patent: Aug. 21, 2012

(54) APPARATUS FOR MAINTAINING PROPER ORIENTATION OF AN AIMING EYE WHEN FIRING A SHOTGUN

(76) Inventor: Cleveland C. Smith, Helena, MT (US)

( * ) Notice: Subject to any disclaimer, the term of this patent is extended or adjusted under 35 U.S.C. 154(b) by 99 days.

(21) Appl. No.: 12/800,678

(22) Filed: May 19, 2010

(51) Int. Cl.
*F41G 1/00* (2006.01)

(52) U.S. Cl. ..... 42/112

(58) Field of Classification Search ..... 42/111, 42/112, 137, 144, 141, 131–134, 139, 142, 42/143; 89/41.19; 33/297, 293
See application file for complete search history.

(56) References Cited

U.S. PATENT DOCUMENTS

| | | | | | |
|---|---|---|---|---|---|
| 298,659 | A | * | 5/1884 | Berthoud | 42/133 |
| 744,651 | A | | 11/1903 | Vickery | |
| 752,962 | A | | 2/1904 | Eby | |
| 1,226,952 | A | * | 5/1917 | Dyer | 42/141 |
| 1,421,553 | A | * | 7/1922 | Pohl | 42/141 |
| 1,835,938 | A | * | 12/1931 | Ewen | 42/144 |
| 2,056,469 | A | | 10/1936 | King | |
| 2,092,356 | A | | 9/1937 | Prather | |
| 151,408 | A | | 10/1948 | Richards | |
| 2,458,638 | A | | 1/1949 | Pretzer | |
| 2,498,329 | A | | 2/1950 | Barnes | |
| 2,563,193 | A | | 8/1951 | Seymore | |
| 2,585,345 | A | * | 2/1952 | Procos | 42/139 |
| 2,586,807 | A | | 2/1952 | Fowler | |
| 2,730,806 | A | | 1/1956 | Williams et al. | |
| 2,741,029 | A | | 4/1956 | Councill | |
| 2,874,504 | A | | 2/1959 | Martinek | |
| 2,904,888 | A | * | 9/1959 | Niesp | 42/141 |
| 2,969,594 | A | | 1/1961 | Palmer | |
| 2,970,380 | A | | 2/1961 | Hill | |
| 3,028,674 | A | | 4/1962 | Luebkeman | |
| 3,178,824 | A | | 4/1965 | Callihoe | |
| 3,187,436 | A | | 6/1965 | Friedrichsmeier | |
| 4,008,536 | A | | 2/1977 | Adams | |
| 4,112,583 | A | | 9/1978 | Castilla | |
| 4,223,446 | A | * | 9/1980 | Villa | 42/141 |
| 4,745,686 | A | | 5/1988 | Willis | |
| 5,054,204 | A | | 10/1991 | Ward et al. | |
| 5,070,619 | A | | 12/1991 | Santiago | |
| 5,373,657 | A | | 12/1994 | Betz et al. | |
| D376,406 | S | | 12/1996 | Rosen et al. | |
| D393,306 | S | | 4/1998 | Couper | |

(Continued)

*Primary Examiner* — Bret Hayes
*Assistant Examiner* — Reginald Tillman, Jr.
(74) *Attorney, Agent, or Firm* — Todd N. Hathaway

(57) ABSTRACT

An aiming apparatus for shotguns, that aids in maintaining correct head position and alignment of the aiming eye with the rib of the shotgun. Warning sight elements are positioned below the upper edges of the rib and forward of rearwardly located blinders, so that the warning sight elements are obscured when the aiming eye is correctly positioned level with the upper surface of the rib but become visible when the aiming eye are incorrectly raised to an elevated position. The warning sight elements also emerge from behind sides of the blinders if the aiming eye is moved laterally to a position offset from the rib. A centerline aiming element is positioned atop the rib and is visible through an aperture when the aiming eye is in the correct position, but becomes obscured when the aiming eye is moved upwardly or laterally out of the correct position. The warning and aiming sight elements are formed of rods of light-gathering optic fiber and have contrasting colors, preferably red/orange and green. The assembly mounts to the shotgun by a channel portion that fits over the rib. The assembly also serves to prevent problems with cross-dominance by the non-aiming eye.

35 Claims, 23 Drawing Sheets

U.S. PATENT DOCUMENTS

| | | | | |
|---|---|---|---|---|
| 5,836,100 | A | 11/1998 | Stover | |
| 5,878,503 | A | 3/1999 | Howe et al. | |
| 5,956,854 | A | 9/1999 | LoRocco | |
| D421,785 | S | 3/2000 | Uhlmann et al. | |
| D423,630 | S | 4/2000 | Flubacher et al. | |
| 6,058,615 | A * | 5/2000 | Uhlmann et al. | 42/132 |
| 6,085,427 | A | 7/2000 | Persson | |
| 6,216,351 | B1 * | 4/2001 | Flubacher et al. | 42/145 |
| 6,421,946 | B1 | 7/2002 | LoRocco | |
| 6,446,377 | B1 | 9/2002 | Hollenbach et al. | |
| 6,598,331 | B1 * | 7/2003 | Thibodeaux | 42/111 |
| 6,604,315 | B1 | 8/2003 | Smith et al. | |
| 6,622,413 | B1 | 9/2003 | Bickett | |
| 6,678,987 | B2 | 1/2004 | Howe | |
| 6,722,075 | B1 * | 4/2004 | Gabaldon | 42/141 |
| 6,860,056 | B2 * | 3/2005 | Howe | 42/132 |
| 7,328,531 | B2 | 2/2008 | Dietz | |
| 8,037,634 | B2 * | 10/2011 | Price | 42/133 |

* cited by examiner 80
80
80
80
10

APPARATUS FOR MAINTAINING PROPER ORIENTATION OF AN AIMING EYE WHEN FIRING A SHOTGUN

BACKGROUND OF THE INVENTION

The present invention relates generally to sighting aids for shotguns, and, more particularly, to an apparatus that aids a shooter in maintaining the aiming eye at a proper elevation relative the rib and bead of a shotgun.

RELATED ART

Shotgun sights differ significantly from the sights used on rifles and other firearms. Since a shotgun fires a pattern of pellets rather than a single slug, speed of acquisition and pointing are generally more important than precise accuracy. For example, bird hunting, skeet shooting and trap shooting all involve comparatively close, fast-moving targets, as opposed to rifle shooting, where the target is usually at a longer range and the angular rate of movement is much less.

Because of these different requirements, the sights used on other types of long arms are generally unsuitable for shotguns. For example, conventional iron sights for rifles generally have an open or "peep" rear sight on or near the receiver and a post or bead at the muzzle end of the barrel, the goal being to achieve very precise alignment in both elevation and azimuth. However, this arrangement requires comparatively slow and deliberate aiming, and moreover the sight picture is comparatively small, so that these types of sights are generally ill-suited for use on shotguns. Telescopic rifle sights can achieve even greater accuracy, but for similar reasons they too are unsuitable for use on shotguns (except for deer hunting using slugs and other specialized). A great many other types of sights have, of course, been developed or proposed over the long history of firearms, however the majority have for various reasons been for shotgun use.

By comparison with rifle sights, shotgun sights ordinarily lack a rear sight opening. Instead, there is commonly a rib along the top of the barrel (or between the barrels in the case of a side-by-side), with a small bead being mounted at the forward end of the rib. Although this arrangement permits extremely quick pointing when firing at close, fast-moving targets, it does present certain challenges that can be very difficult to master.

One particular difficulty is that of maintaining the aiming eye at the proper level relative to the barrel. Since there is no rear sight opening to look through, proper elevation of the barrel depends on the user keeping his aiming eye closely level with the rib, usually with the cheek held against the butt stock and the eye looking just over the top of the receiver. However, this is more easily said than done; similar to the situation with a golf swing, there is a recurring tendency for the shooter to lift his head and raise his eye above the proper level. As the shooter raises his head, the tendency is to raise the front bead as well, with the result that the barrel is elevated too far and the shot misses the target.

To illustrate this situation, FIG. 1 shows a shotgun 01 having conventional sights, consisting up of a rib 02 that extends along the top of the barrel 03 and a front bead 04 that is mounted proximate the forward end of the barrel. As noted above, proper aiming requires that the sighting eye be held essentially level with the rib 02, looking forward over the top of the receiver 05. However, as can be seen in FIG. 2, inadvertent lifting of the head causes the aiming eye 06 to be raised above the proper level, so that when the front bead 04 its positioned on the line of sight 07 from the eye to the target 08 the barrel is in fact angled too high and the shot passes over the target, as indicated by arrow 09.

This is an extremely common problem, and is perhaps most pronounced when firing multiple shots in quick succession, since the first shot tends to break the shooter's concentration and the recoil also causes the gun to move rearwardly and downwardly relative to the aiming eye. As a result, shooters constantly have to remind themselves to keep their heads down, but in the absence of an effective visual reference it is in fact very difficult to keep the aiming eye at the proper level under such circumstances.

Another, somewhat related difficulty is that of cross dominance, wherein the non-sighting eye becomes dominant and the barrel becomes misaligned in the direction of azimuth. This is due to the fact that the non-aiming eye is not in direct vertical alignment above the aiming eye, since the head is tilted at an angle when held in a normal aiming position. Thus, if the non-aiming eye becomes dominant there is a tendency for the shooter to inadvertently aim to one side or the other of the target; for example, if the shooter is aiming with the right eye and the left eye becomes dominant, there will be a tendency to shoot to the left of the target due to the different angular positions of the two eyes, i.e., due to the left eye being positioned to the left of the aiming eye.

In addition to aspects relating to the shooter's vision, the structure and function of the firearm itself must also be taken into account. For example, significant additional weight, especially at the muzzle end of the barrel or barrels, can have a dramatic impact on the handling of a shotgun, which in many cases has been carefully designed (or adjusted) to have a particular balance. Also, any form of sight that requires permanent modification may seriously diminish resale value of a shotgun, and may involve the inconvenience and expense of installation by a gunsmith. At the same time, however, the sight must have a structure and mounting such that it is able to withstand the very significant shock and recoil forces inherent in the normal operation of a shotgun, as well as the routine impacts and striking against objects that occurs during use in a field environment. Also, even though shotgun shooting is not an inexpensive activity, cost of the sight remains an important consideration.

Accordingly, there exists a need for an apparatus for assisting a shooter in maintaining his aiming eye at the proper elevation relative to the rib and front bead when using a shotgun. Furthermore, there exists a need for such an apparatus that does not interfere with the ability of the shooter to rapidly acquire the target and point the shotgun when using rib-and-bead sights. Still further, there exists a need for such an apparatus that provides the shooter with a distinctive and virtually instantaneous indication when his eye has been raised above the proper level, so that the shooter is able to reposition his head in a quick and reflexive manner. Still further there exists a need for such an apparatus that assists in maintaining proper side-to-side alignment of the sighting eye and also inhibits cross-dominance by the non-sighting eye. Still further, there exists a need for such an apparatus that is able to withstand the shock and recoil forces inherent in the operation of a shotgun. Still further, there exists a need for such an apparatus that does not require permanent modification of the shotgun, and doe not require the services of a professional gunsmith for installation. Still further, there exists a need for such an apparatus that is lightweight and simple in construction, and which does not encumber the shotgun or impair its handling. Still further, there exists a need for such an apparatus that is sufficiently reliable to be used in a field environment, and that is sufficiently inexpensive to manufacture that it can be made widely available to target shooters and hunters.

SUMMARY OF THE INVENTION

The present invention addresses the problems cited above, and is an aiming apparatus for a shotgun that helps insure proper positioning of the shooter's head and aiming eye relative to the rib of the shotgun.

In a broad aspect, the aiming apparatus comprises: (a) a housing that is mountable to a rib of a shotgun, (b) at least one warning sight element mounted to the housing so as to be positioned generally below and offset to a side of an upper surface of the rib, and (c) at least one blinder portion mounted on the housing so that an upper edge of the blinder portion is positioned rearwardly of the at least warning sight element and generally level with the upper surface of the rib, (d) so that the warning sight element is obscured by the upper edge of the blinder portion from view of an aiming eye when the aiming eye is in a correct position substantially level with the upper surface of the rib, and is at least partially visible above the upper edge of the blinder portion when the aiming eye is in an incorrect position elevated above the upper surface of the rib.

The at least one warning sight element may comprise first and second warning sight elements mounted to the housing so as to be positioned generally below and offset to opposite sides of the upper surface of the rib. The at least one blinder portion may comprise first and second blinder portions mounted on the housing so that upper edges of the blinder portions are positioned rearwardly of first and second warning sight elements on opposite sides of the upper surface of the rib.

The aiming apparatus may further comprise an aiming sight element mounted to the housing intermediate the first and second warning sight elements so as to be positioned generally level and in longitudinal alignment with the upper surface of the rib. The apparatus may further comprise a sight portion mounted on the housing so that an opening of the sight portion is positioned rearwardly of the aiming sight element and generally level and in longitudinal alignment with the upper surface of the rib, so that the aiming sight element is visible to the aiming eye through the opening of the sight portion when the aiming eye is in the correct position substantially level with the upper surface of the rib, and is at least partially obscured by an edge of the opening of the sight portion when the aiming eye is in an incorrect position elevated above the upper surface of the rib. The aiming portion may comprise an elongate enclosed passage extending from the aiming sight element proximate a forward end of the housing to the opening of the sight portion proximate a rearward end of the housing.

The first and second blinder portions may each further comprises outer edges that are positioned rearwardly and outwardly of the first and second warning sight elements, so that the warning sight elements are obscured by the outer edges of the blinder portions from view by the aiming eye when the aiming eye is in a correct position substantially in longitudinal alignment with the rib, and are at least partially visible outside the outer edges of the blinder portions to the aiming eye when the aiming eye is in incorrect positions offset from longitudinal alignment with the rib.

There may be a single set of first and second warning sight elements for being located proximate a muzzle end of the rib of said shotgun, or there may be a plurality of sets at first and second warming sight elements for being mounted at spaced locations along said rib of the shotgun.

The warning sight elements and aiming sight element may each comprise a rod formed of light-gathering optic fiber material. The apparatus may further comprise means for mounting the rod of the aiming sight element substantially level and in longitudinal alignment with the upper surface of the rib of the shotgun, so that the rod of the aiming sight element is viewed substantially in end-on alignment by the aiming eye when the aiming eye is in the correct position substantially level with the upper surface of the rib. The apparatus may further comprise means for mounting the rods of the first and second warning sight elements in an upward angle towards the rearward end of the housing, so that the rods of the warning sight elements are viewed substantially in end-on alignment by the aiming eye when the aiming eye is in an incorrect position elevated above the upper surface of the rib.

The optic fiber material of the aiming sight element may be an optic fiber material having a first color, and the optic fiber material of the warning sight elements may be a fiber optic material having a second color that provides a visible contract with the first color. The first color may be a color having a substantially green hue and the second color may be a color having a substantially red hue.

The housing of the aiming apparatus may comprise means for attaching the housing to the rib of a shotgun. The means for attaching the housing to the rib of the shotgun may comprise a channel portion having first and second depending, generally parallel walls spaced apart to receive the rib in close-fitting engagement therewith, and an upper wall that spans the depending walls to contact the upper surface of the rib. The means for attaching the housing to the rib of the shotgun may further comprise first and second pairs of inwardly-biased finger portions that project from forward and rearward of the depending sidewalls for pressing against sides of said rib so as to establish a grip thereon. The means for attaching the housing to a rib of a shotgun may further comprise at least one magnet mounted to the upper wall of the channel portion for establishing a magnetic engagement with the rib.

In a preferred embodiment, the aiming apparatus comprises: (a) an elongate housing that is mountable to a rib of a shotgun, the housing comprising (i) a channel portion for attachment to the rib of a shotgun, the channel portion comprising first and second depending, substantially parallel sidewalls that are spaced apart to from a gap sized to receive the rib of a shotgun in close-fitting engagement therewith, the depending walls being shorter in height than a height of the rib, an upper wall that spans the depending sidewalls for contacting an upper surface of the rib, first and second pairs of opposed, inwardly-biased finger portions that extend from ends of the depending sidewalls for pressing against sides of the rib so as to establish a grip thereon, and at least one magnet that is mounted to the upper wall of the channel portion for establishing a magnetic engagement with the rib when the upper wall is in contact therewith, (ii) a sight passage that is located atop the upper wall of the channel portion, the sight passage comprising an elongate, substantially enclosed passage extending along a centerline of the upper wall so as to be positioned generally proximate to and in longitudinal alignment with the upper surface of the rib of the shotgun when the assembly is mounted on the rib, a coaxial opening at a forward end of the enclosed passage, and a coaxial aperture at a rearward end of the enclosed passage, through which the opening at the forward end of the passage can be viewed by an aiming eye, and (iii) first and second blinder portions that extend laterally from the depending walls of the channel portion on opposite sides of the housing, the blinder portions each comprising an outwardly extending panel having an upper edge that is substantially level with a lower edge of the aperture and a depending outer edge that is spaced outwardly from an outer surface of the depending wall of the channel portion; and (b) a plurality of sight elements located proximate a forward end of the sight assembly, the plurality of sight elements comprising (i) an aiming sight element formed of a rod of light-collecting optic fiber having a first color, the aiming sight element being mounted atop the upper wall of the channel portion forward of and in coaxial alignment with the enclosed sight passage, a rearward end of the rod of the aiming sight member being received in the opening at the forward end of the enclosed sight passage, and (ii) first and second warning sight elements formed of rods of optic fiber having a second color that forms a visual contrast with the first color, the warning sight elements being mounted to the outer surfaces of the depending walls on opposite sides of the channel portion substantially parallel to the centerline of the upper wall of the channel portion and at an angle extending upwardly towards the rearward end of the housing, rearward ends of the rods of the warning sight elements being positioned below the upper edges of the panels of the blinder portions and inboard of the outer edges of the panels of the blinder portions; (c) so that the rearward end of the aiming sight element is visible through the aperture of the sight passage by an aiming eye when the aiming eye is in a correct position substantially level and in longitudinal alignment with the upper surface of the rib of a shotgun, and is at least partially obscured by an edge of the aperture of the sight passage when the aiming eye is in an incorrect position elevated above or offset laterally from the upper surface of the rib, and so that the rearward ends of the warning sight elements are obscured behind the upper and outer edges of the panels of the blinder portions from view by the aiming eye when the aiming eye is in the correct position substantially level and in longitudinal alignment with the upper surface of the rib of the shotgun, and are at least partially visible above or to the side of the upper and outer edges of the panels of blinder portions when the aiming eye is in an incorrect position elevated above or offset laterally from the upper surface of the rib.

BRIEF DESCRIPTION OF DRAWINGS

FIG. 7 is a top plan view of the sighting apparatus of FIGS. 5-6, showing the parallel relationship of the centerline and outboard optic fiber rods relative to a vertical plane perpendicular to the top surface of the rib of the shotgun, and also the laterally extending blinder portions of the apparatus located proximate the rearward end thereof;

DETAILED DESCRIPTION

Figure 5:
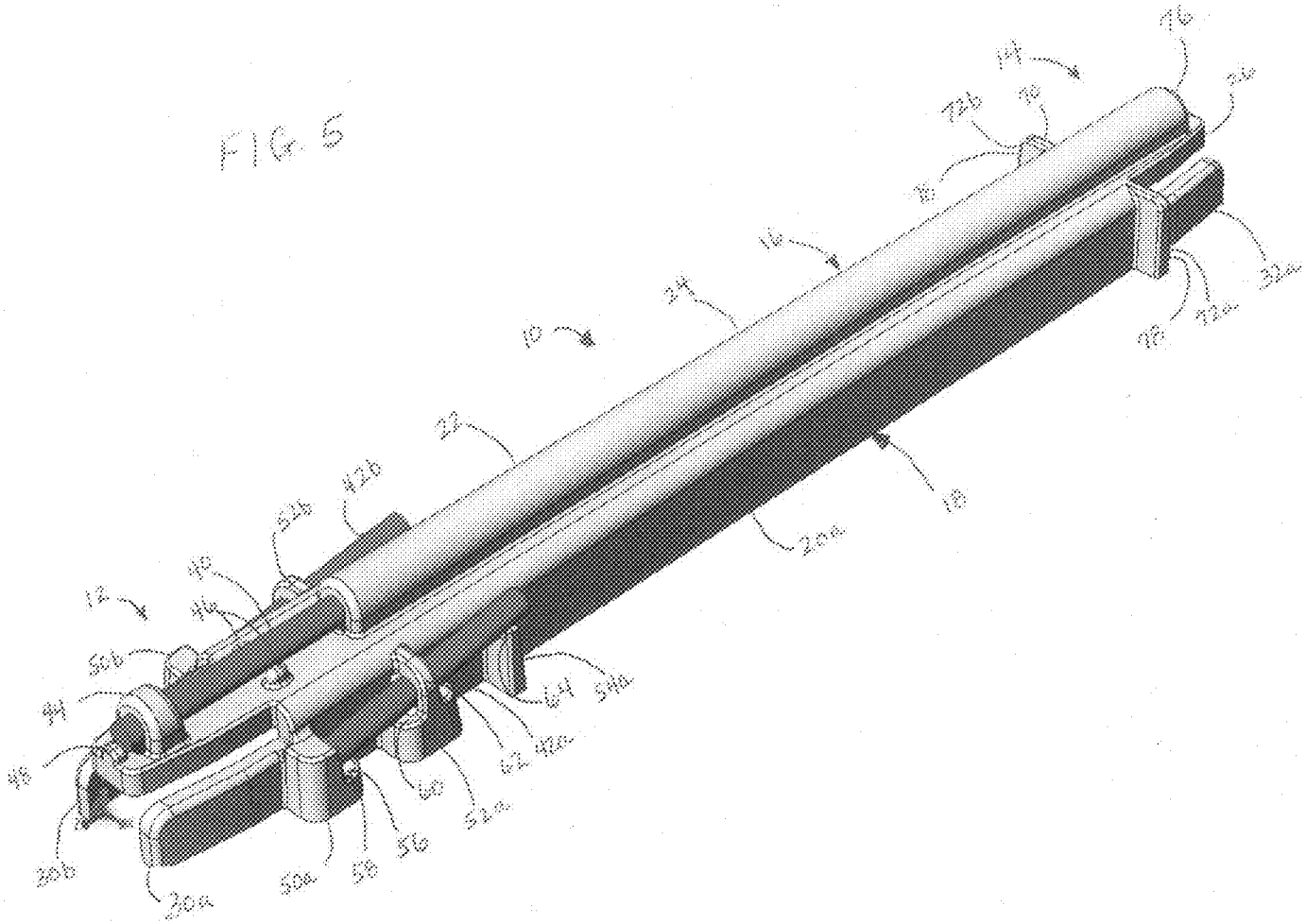
FIG. 5 is front perspective view of a shotgun sighting apparatus in accordance with the present invention, showing the elongate housing of the apparatus that fits over and mounts to the rib of the shotgun, and the arrangement of central and flanking outboard optic fiber rods that form aiming and warning elements proximate the muzzle end of the barrel of the shotgun.

FIG. 5 shows a sighting apparatus 10 in accordance with the present invention, having forward and rearward ends indicated generally at 12 and 14 respectively.

Figure 1:
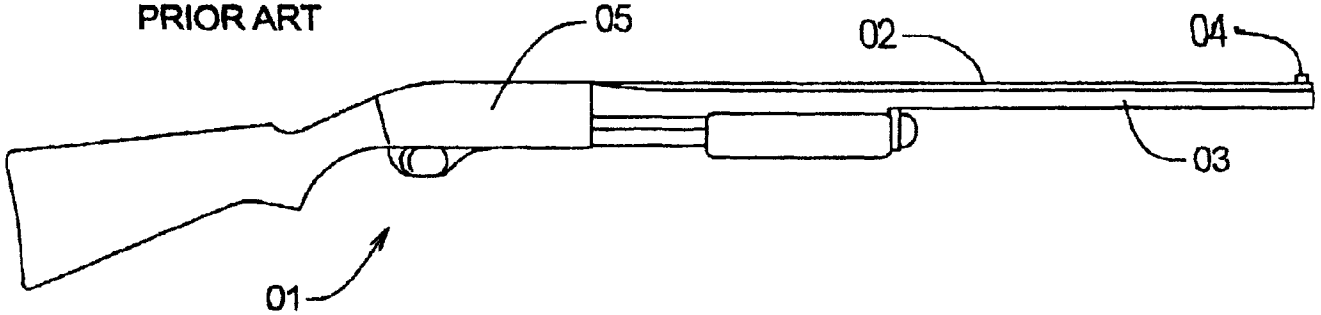
FIG. 1 PRIOR ART
FIG. 1 is an elevational view of a shotgun having conventional rib and bead sights in accordance with the prior art.
Figure 2:
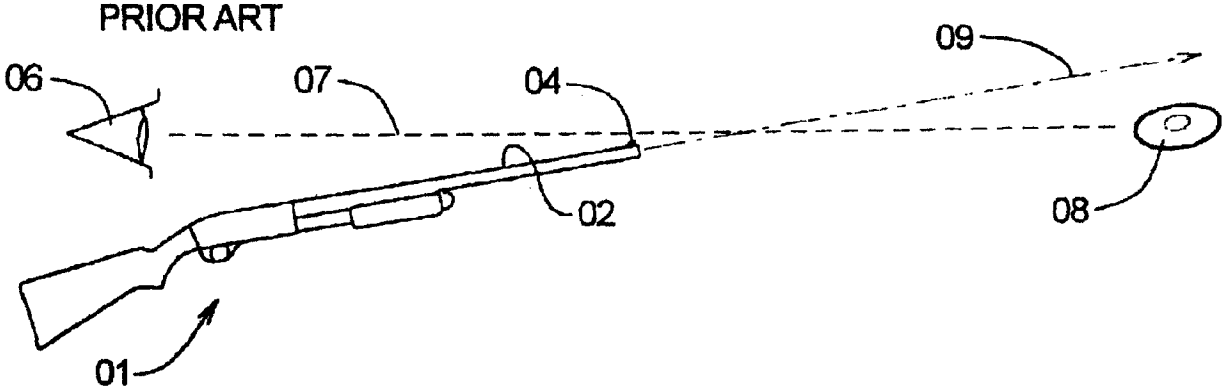
FIG. 2 PRIOR ART
FIG. 2 is an elevational, somewhat schematic view of the shotgun of FIG. 1 and a moving target, showing the manner in which improperly lifting the aiming eye above the level of the rib causes the shot to go high and miss the target.
Figure 3:
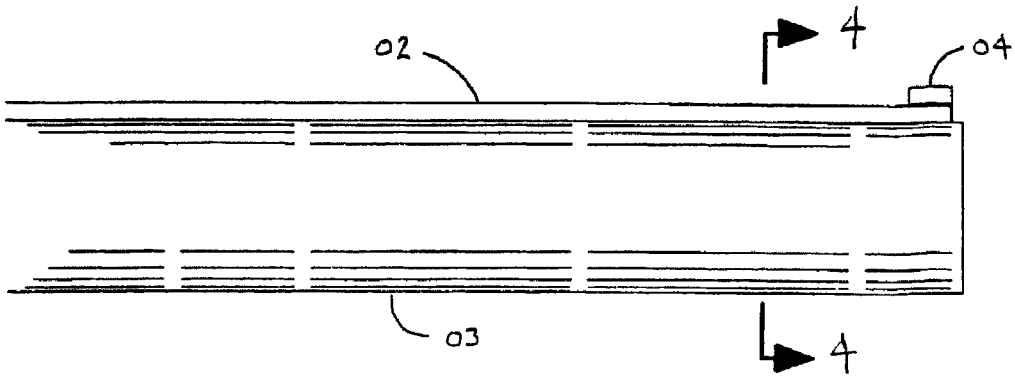
FIG. 3 is a partial side, elevational view of the muzzle end of the barrel of the shotgun of FIGS. 1-2, showing the configuration of the raised rib and bead in greater detail.
Figure 4:
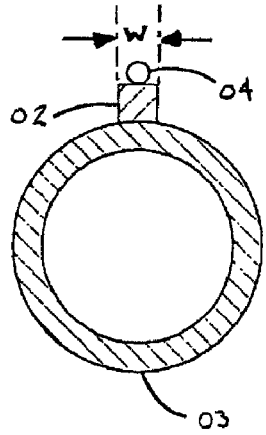
FIG. 4 is a transverse cross-sectional view of the muzzle end of the barrel shown in FIG. 3, taken along line 4-4 therein, showing in greater detail the configuration of the rib and bead and their relationship to the barrel of the shotgun.

As can be seen, the principal structural component of the apparatus is an elongate housing 16 that is suitably formed of injection moulded plastic or similar material, that is substantially rigid but posses a degree of resilient flexibility. The lower part of the housing includes a channel portion 18 having depending walls 20*a*, 20*b* (see also FIG. 8), while the upper part includes a sight passage 22 defined by an inverted U-shaped channel portion 24 set atop a horizontal upper wall 26 of the channel portion. As will be described in greater detail below, the inside lateral spacing between depending walls 20*a*, 20*b* is approximately equal to a predetermined width "w" of the shotgun rib 02 (see FIG. 4) so that the walls will fit tightly against the sides of the rib when the latter is positioned in the channel portion 18, while the height of the walls 20*a*, 20*b* is somewhat less than the height of the rib so that the top wall 26 of the channel portion will rest flat against the top surface of the rib to insure that the correct angular relationship is established between the rib and the aiming components of the assembly, including a parallel relationship between the rib and the centerline sight passage 22. Inwardly angled distal extensions of the depending walls 20*a*, 20*b* form pairs of resilient finger 30*a*, 30*b* and 32*a*, 32*b* at the forward and rearward ends of the housing that serve to establish a grip against the side surfaces of the rib, as will also be described in greater detail below. In the illustrated embodiment, the length of the housing 16, and therefore that of the overall assembly 10, is suitably about 10 cm, although it will be understood that this may vary depending on design factors, and the housing may have any length suitable for mounting to the rib of the shotgun.

As can be seen with further reference to FIG. 5, a group of light-gathering optic rods are mounted to housing 16 at the forward end of the assembly, namely, a centerline light-gathering optic rod 40 flanked by a pair of outboard light-gathering optic rods 42*a*, 42*b*. The optic rods are suitably formed of short lengths of polymeric (e.g., acrylic) optic fiber, preferably fluorescent, that collect ambient light and present the image of a bright "dot" at the cut ends; fluorescent optic fibers for use in sights for archery and firearms are available, for example, from Nan Optics, 3014 NE 21$^{st}$ Way, Gainesville, Fla., USA (www.nanoptics.com). Polymeric optic fiber is lightweight, tough and weather resistant, and in combination with the plastic housing serves to form a lightweight and durable assembly. In the illustrated embodiment the optic fiber rods suitably have a diameter of approximately 2 mm and a length of about 20 mm, although it will be understood that other dimensions may be used depending on design factors.

As will be described in greater detail below, the ends of the optic rods 40 and 42*a*, 42*b* are disposed towards the shooter and therefore present bright "dots" that can be seen at different positions when aiming the shotgun, with the centerline rod forming an aiming element visible to the aiming eye when the latter is in the correct position relative to the rib and the outboard rods forming warning elements that become visible to the aiming eye when it is raised and/or shifted laterally to an incorrect position. The centerline and outboard rods are consequently preferably formed of contrasting colors, which in the preferred embodiment that is illustrated are fluorescent green for the centerline rod 40 and fluorescent re/orange for the outboard rods 42*a*, 42*b*, thus making use of the commonly pre-existing mental association of these colors with "go" and "stop" acquired from experience with traffic signals, although it will be understood that other or additional colors may be used as well.

As can be seen with further reference to FIG. 5 and FIGS. 6-7 and 9-11, the forward end 12 of housing 16 includes structural features for attaching and supporting the rods in their respective orientations with their rearward ends directed towards the aiming eye, while at the same time leaving each rod exposed over most of its length so as to be able to collect ambient light.

The centerline optic rod 40, which as noted above is preferably green in color, rests atop the upper wall 26 of the housing, with its rearward end disposed within the forward end opening of channel 24 of the enclosed centerline sight passage and with its forward end projecting through a collar 44 formed on the upper side of wall 26. A pair of projecting knobs 46 atop wall 26 flank the exposed central portion of optic rod 40 so as to hold the rod straight and stabilize it laterally, while a centerline knob 48 on the distal end of wall 26 holds the rod in place longitudinally, in cooperation with the forward end of channel 24. Since the fiber optic rod material is resiliently flexible, the structure enables the rod 40 to be installed in a rapid and efficient manner, while sliding it through collar 44 from the front and pressing it into the forward end of channel 24 until the distal end of the rod passes over knob 48 and "snaps" down resiliently into position behind it. The mounting structure thus maintains the green centerline rod 40 in coaxial alignment with the sight passage through channel 24 and therefore with the shooter's aiming eye when the latter is in the correct position, as will be described in greater detail below.

The outboard optic rods 42*a*, 42*b*, which as noted above are preferably re/orange in color, are in turn held by a mirror image series of supports 50*a-b*, 52-*a-b* and 54*a-b*. As can be seen with further reference to FIGS. 5 and 9-11, the forward most set of supports 50*a*, 50*b* includes relatively low set shelf areas 56 that are somewhat horizontal but angled upwardly towards the rear, and somewhat vertical stop faces 58 that extend upwardly generally perpendicular to the shelf areas 56. The middle pair of supports 52*a*, 52*b*, in turn, also include shelf areas 60, as well as upwardly extending sleeve or collar portions 62, the angled shelf area 60 lying generally in the same plane as the shelf area of the forward support, and the bore of the collar portion extending generally parallel thereto. Finally, the rearmost pair of supports 54*a*, 54*b* includes angled, generally concave notch or "saddle" areas 64 at their upper ends, and support the projecting rearward ends of the outboard rods 42*a*, 42*b*, the saddle areas 64 again being generally aligned with the corresponding shelf areas of the middle and forward supports. This arrangement enables the outboard rods to be installed in a rapid and efficient manner, by inserting them into the structures from the rear so that they pass through the collar portions 62 until the forward ends come into contact with stop faces 58, the bores of the collar portions being sized to establish a friction-fit engagement that holds the rods firmly in place. The supports thus maintain the rods straight and at the desired angle, while leaving them exposed to ambient light over the greatest part of their lengths. It will be understood, however, that other arrangements of supports or forms of attachment may be used in some embodiments.

In the preferred embodiment that illustrated, the surfaces and bores of the supports are thus arranged to hold the outboard rods at an angle to the plane of the channel portion of the housing, and therefore to the rib of the shotgun when the assembly is mounted thereon, upwardly towards the rear of the assembly. This angle is selected so that the outboard rods will be viewed substantially end-on and, as indicated by axis 66 in FIG. 6, therefore appear brightest, when the shooter's aiming eye is raised a corresponding distance above the receiver end of the rib so that the outboard rods appear above the upper edges 70 of the blinder portion 72 positioned rearwardly of the rods. In the exemplary embodiment that is illustrated, the rods are supported at an angle of about 9° to the plane of the rib, with the upper edges of the blinders 72 positioned level with an about 62.5 mm rearwardly therefrom.

Figure 6:
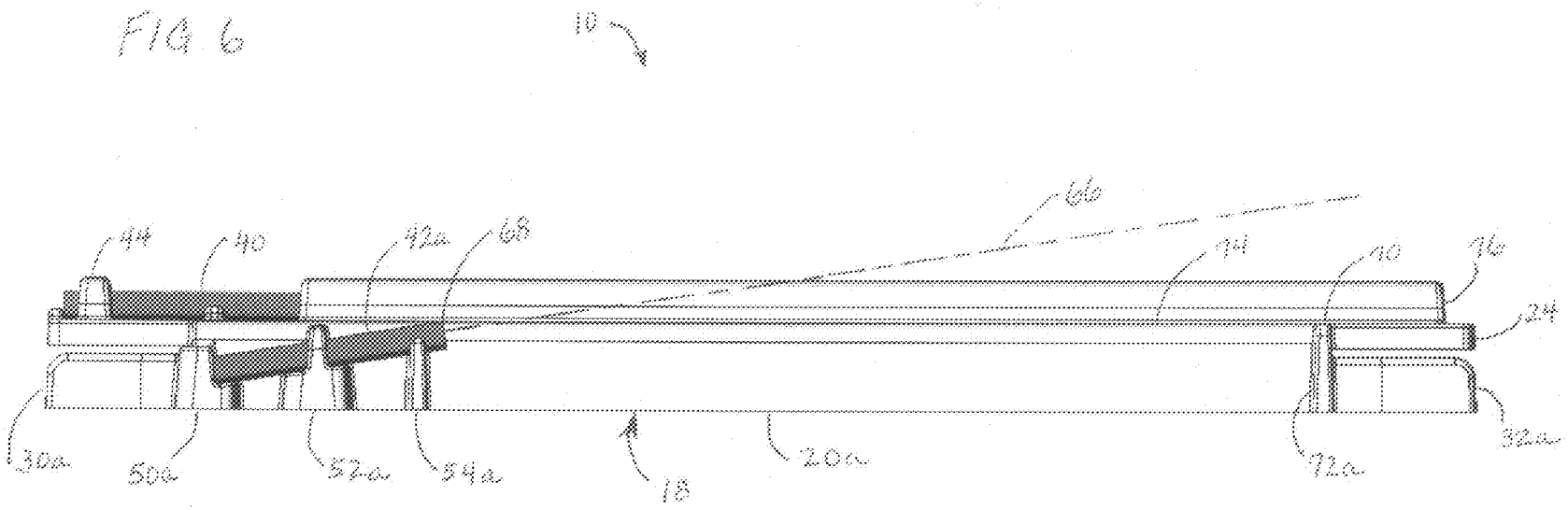
FIG. 6 is a side elevational view of the sighting apparatus of FIG. 5, showing the configuration of the apparatus in greater detail and also the parallel and angled relationship of the centerline and outboard optic fiber rods relative to a horizontal plane defined by a top surface of the rib of the shotgun.
Figure 9:
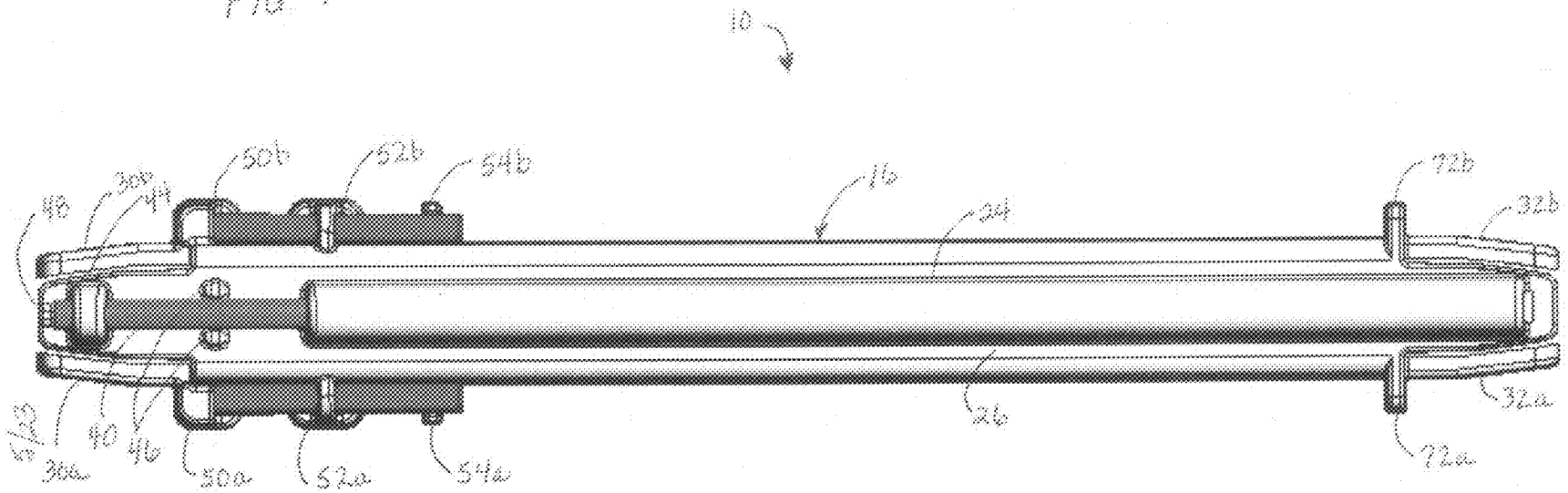
FIG. 9 is a rear perspective view of the sighting apparatus of FIGS. 5-8, showing in greater detail the relationship of the blinder portions at the rearward end of the housing to the optic fiber rods of the aiming and warning sight elements at the forward end.
Figure 15:
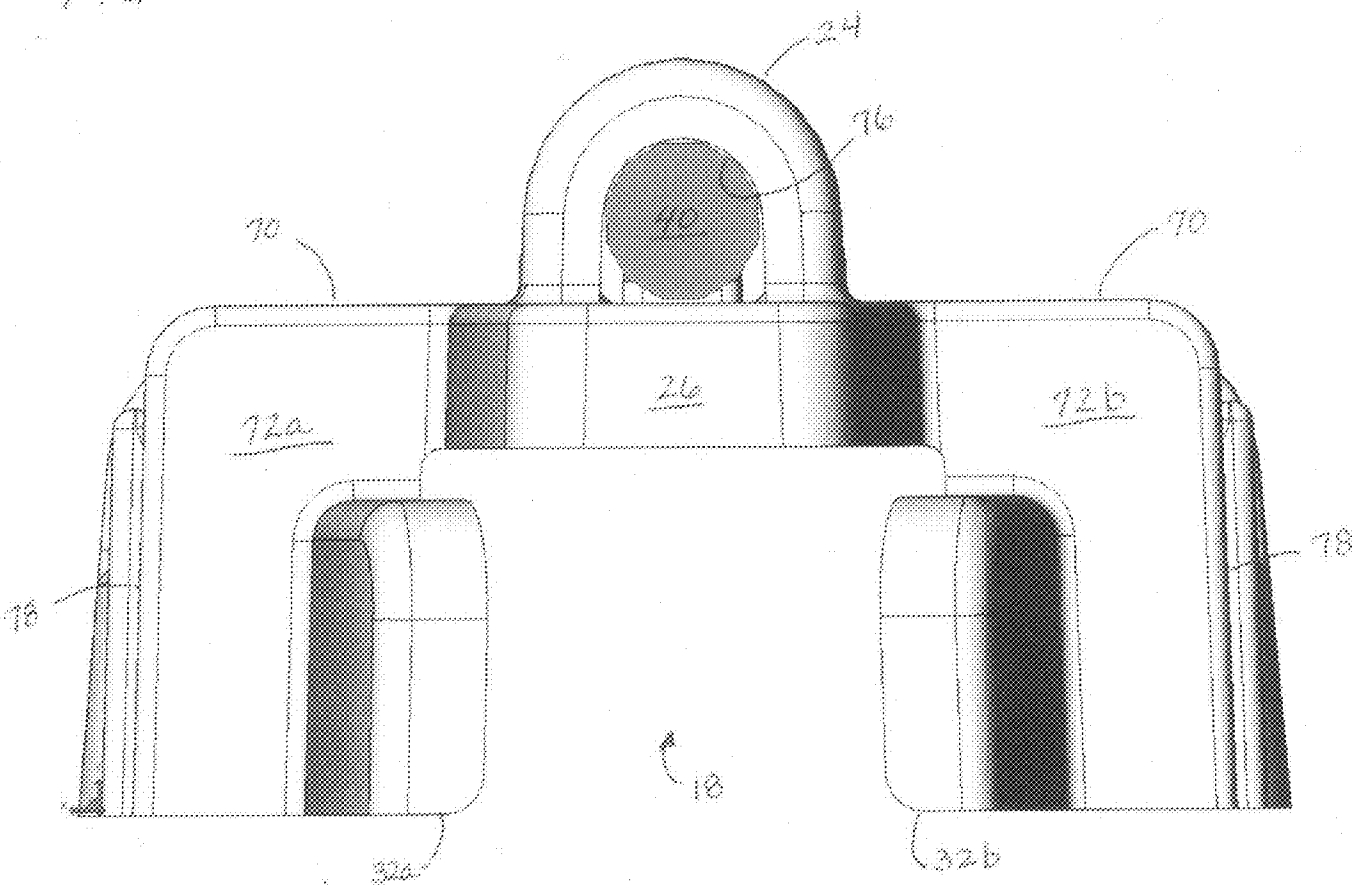
FIG. 15 is a rear elevational view of the sighting apparatus of FIGS. 5-9, as viewed by a shooter's aiming eye when in correct alignment level with and centered on the upper surface of the rib for proper aiming of a shotgun having the apparatus mounted thereto, where the sighting elements at forward end of the apparatus only the centerline rod is visible to the aiming eye, through the centerline sight passage of the housing.
Figure 16:
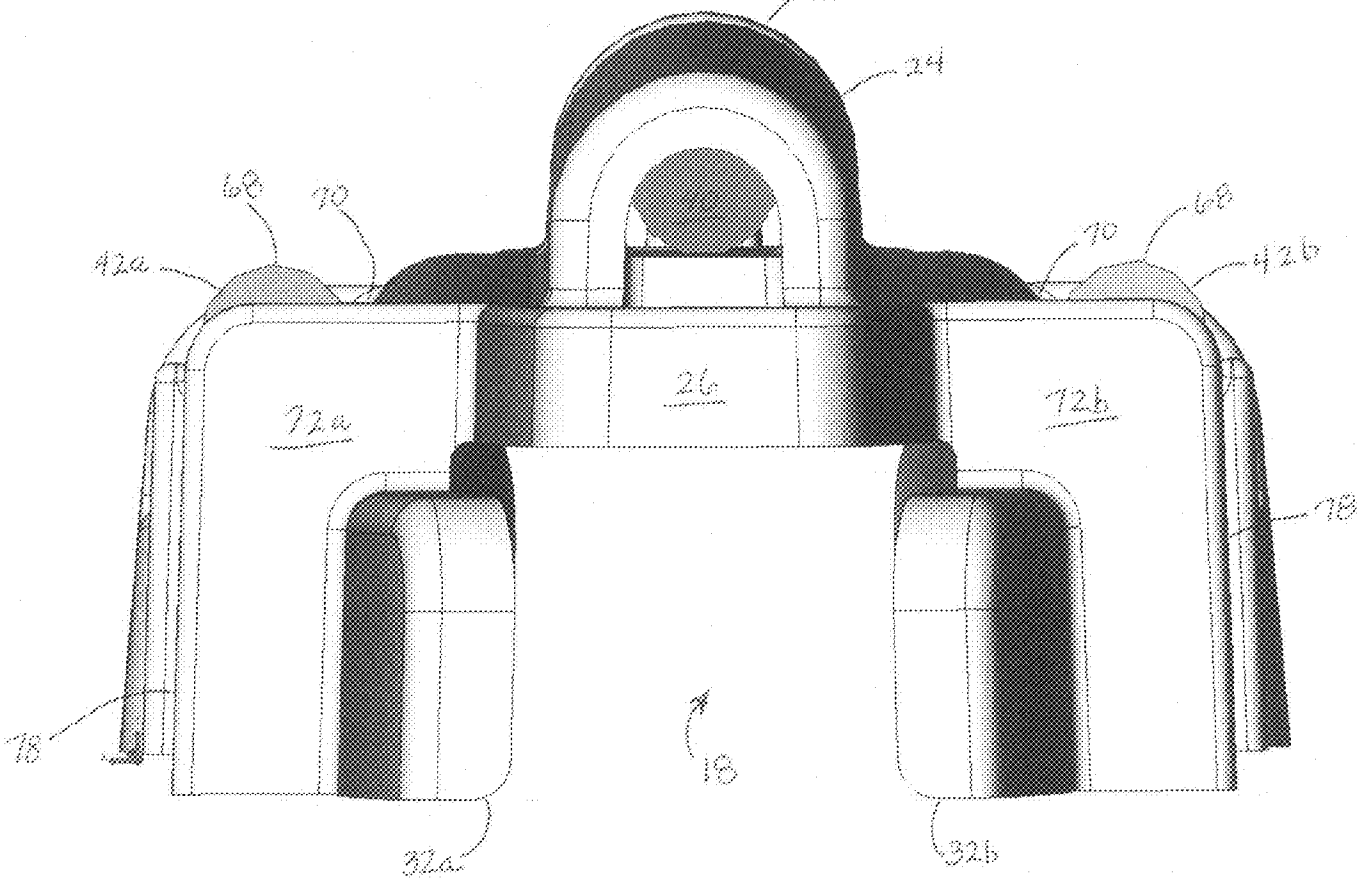
FIGS. 16-18 are sequential, rear elevational views of the sighting apparatus of FIGS. 5-9, similar to FIG. 15, showing the manner in which the outboard optic fiber rods of the warning sight elements become increasingly visible from behind the blinder portions of the housing as the shooter's aiming eye is incorrectly raised to increased elevations above the upper surface of the shotgun rib.

Depending on design factors, the angle of the outboard rods may vary somewhat from that shown, and in some embodiments the outboard rods may not be angled at all, however it is important that the outboard elements be supported in a manner such that they will be obscured from view by the shooter's aiming eye when the aiming eye is held at the correct elevation relative to the rib of the shotgun. Thus, as can be seen in FIG. 6, the supports 50*a-b*, 52*a-b* and 54*a-b* are configured to not only hold the outboard rods at the desired angle, but also so that the uppermost edge portions 68 of the outboard rods are level with the upper edges 70 of the pair of laterally projecting blinders 72*a*, 72*b* located proximate the rearward end 14 of the housing. In particular, in the illustrated embodiment the upper edges 68 of the outboard optic rods and the upper edges 70 of the blinders are both positioned level with the upper surface 74 of the top wall 26 of the channel portion 18 of the housing. The upper edges of the outboard rods and blinders therefore lie a plane that is parallel with and spaced just slightly above (by the thickness of wall 24, e.g., approximately 2 mm) the rib of the shotgun when the sighting assembly is installed thereon, so that the upper edges of the outboard optic rods are obscured (from the aiming eye) just a slight distance below the upper edges of the blinders when the aiming eye is correctly positioned in the plane of the upper surface of the rib. At the same time, though while the outboard optic rods are blocked from view, the centerline optic rod 40 is visible to the aiming eye when the latter is correctly aligned with the rib, through an opening or aperture 76 at the rearward end of sight channel 24, thus presenting the sight picture that will be discussed below with reference to FIG. 15.

As noted above, the channel portion of the housing fits tightly over the rib of a shotgun, and the resilient end fingers 30*a-b* and 32*a-b* engage the sides of the rib to establish a compressive grip thereon. In addition, as can be seen in FIGS. 8 and 12-14, the assembly 10 includes a plurality of permanent magnets 80 that form a magnetic engagement with the steel rib of the shotgun to provide an additional force holding the assembly in place. In the embodiment that is illustrated, the magnets are in the form of thin disks set in recesses 82, 84 in the bottom of upper wall 26, so that the lower surfaces of the magnets lie substantially coplanar with the lower surface of the wall and therefore rest in flat contact with the top of the rib when the assembly 10 is installed thereon. In order to secure the magnets within the channel portion of the assembly, the magnets may be press-fit or co-moulded within the recesses 82, 84, and/or an adhesive material may be used. It will be understood that in some embodiments additional or alternate arrangements of magnets may be used, such as a strip of flat magnetic material installed in the top of the channel portion 18; furthermore, some embodiments may not include any magnet or magnets, and may rely entirely on frictional grip, adhesives, or other forms of engagement.

Figure 8:
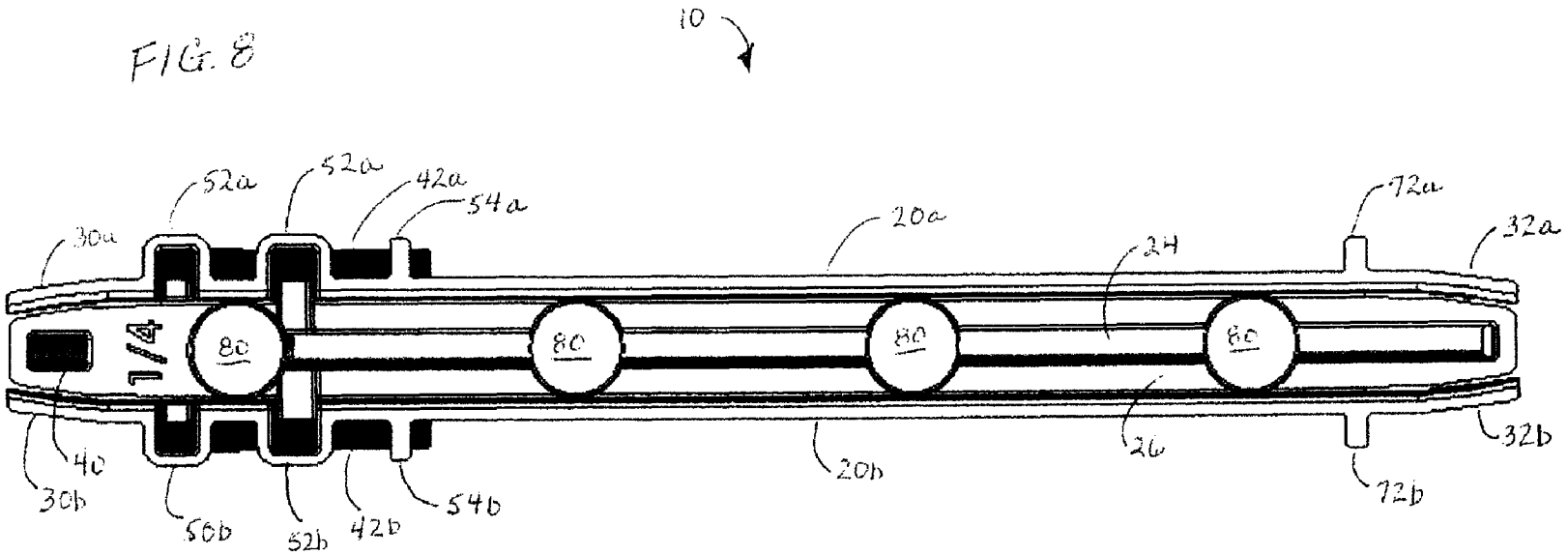
FIG. 8 is a bottom plan view of the sighting apparatus of FIGS. 5-7, showing the channel structure of the housing that fits over and engages the barrel rib of the shotgun and also a plurality of magnets that are recessed in the wall above the channel to form a magnetic engagement with the rib during use of the shotgun.
Figure 9:
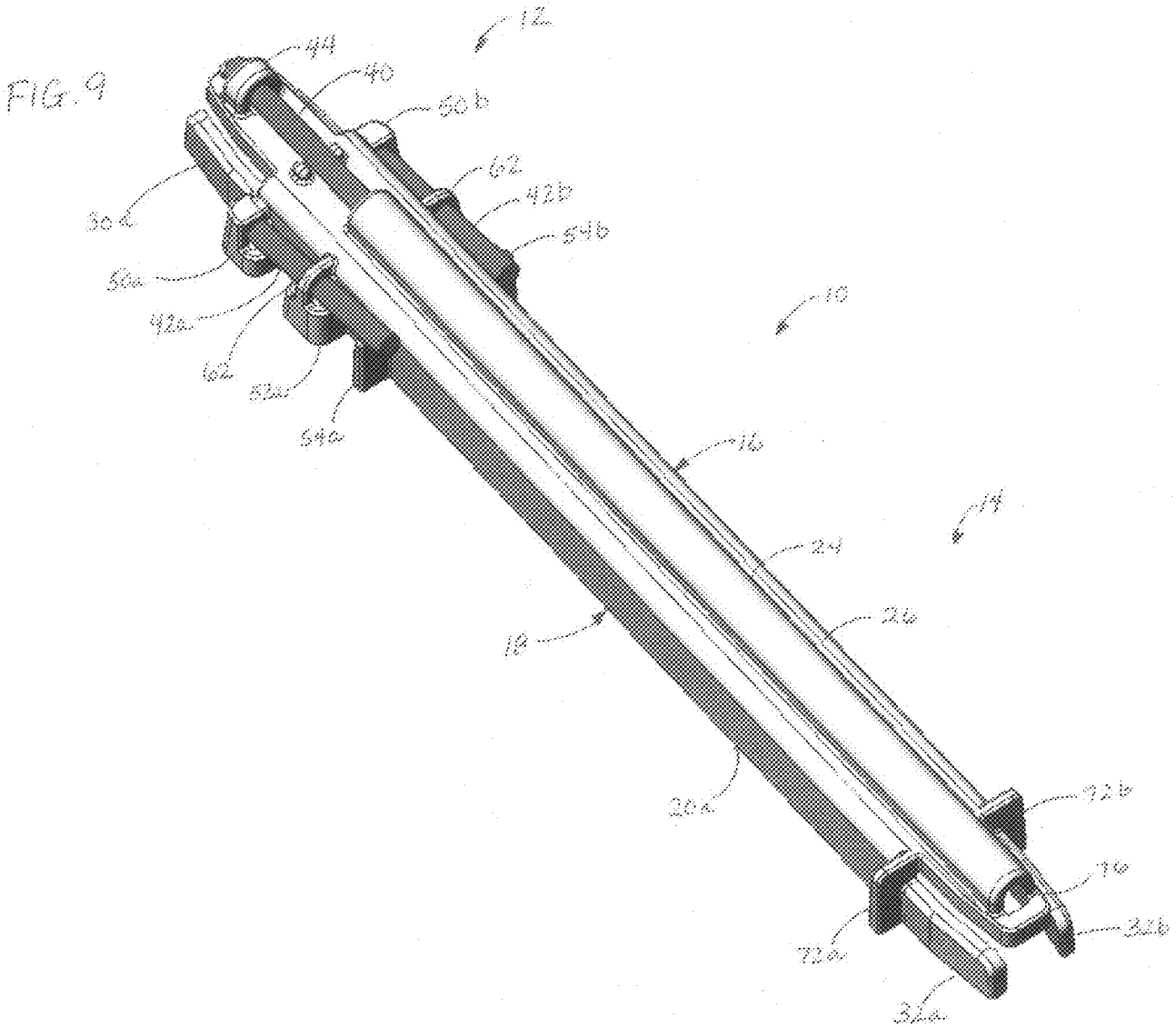
Figure 10:
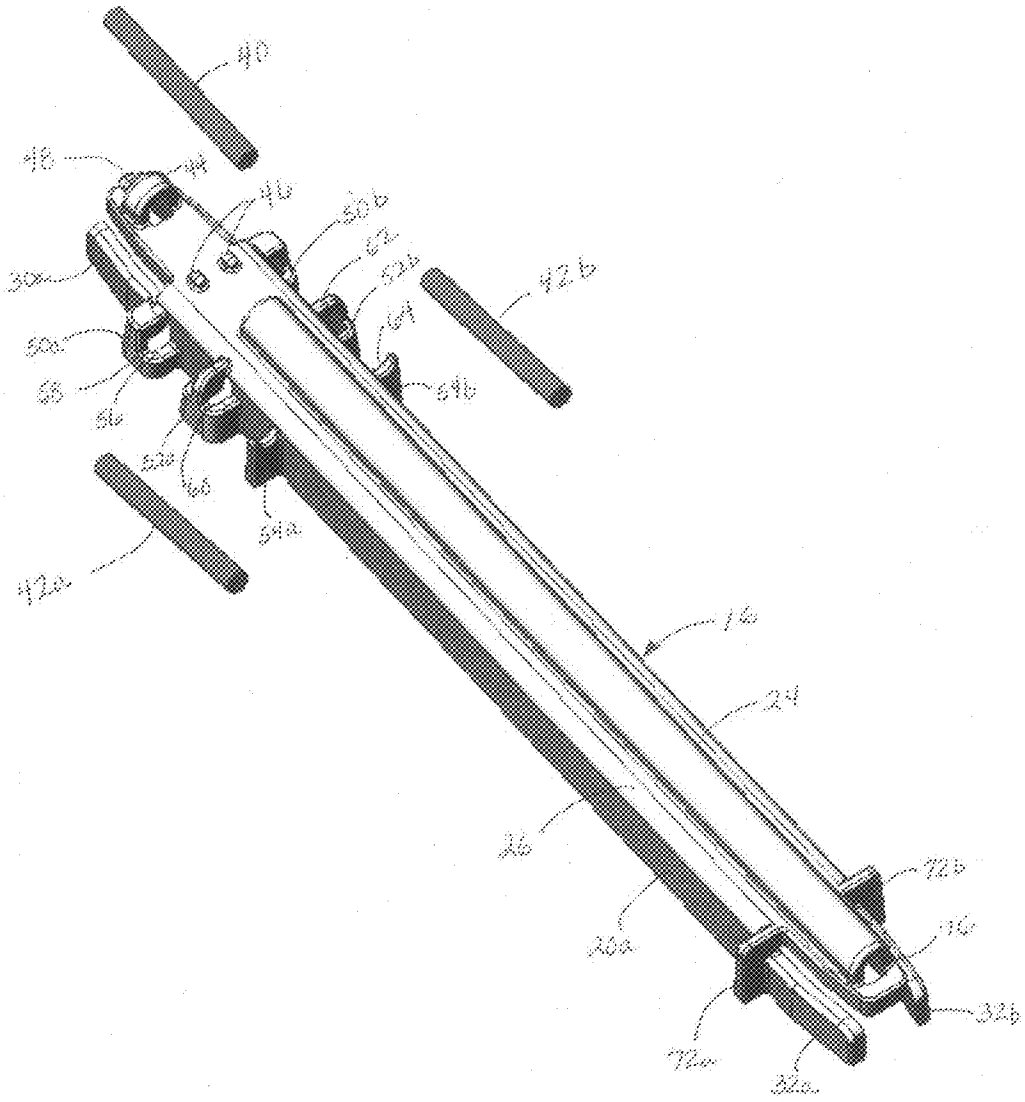
FIG. 10 is a rearward perspective exploded view of the sighting apparatus of FIGS. 5-9, showing the optic fiber rods and the cooperating mounting structures at the forward end of the housing in greater detail.
Figure 11:
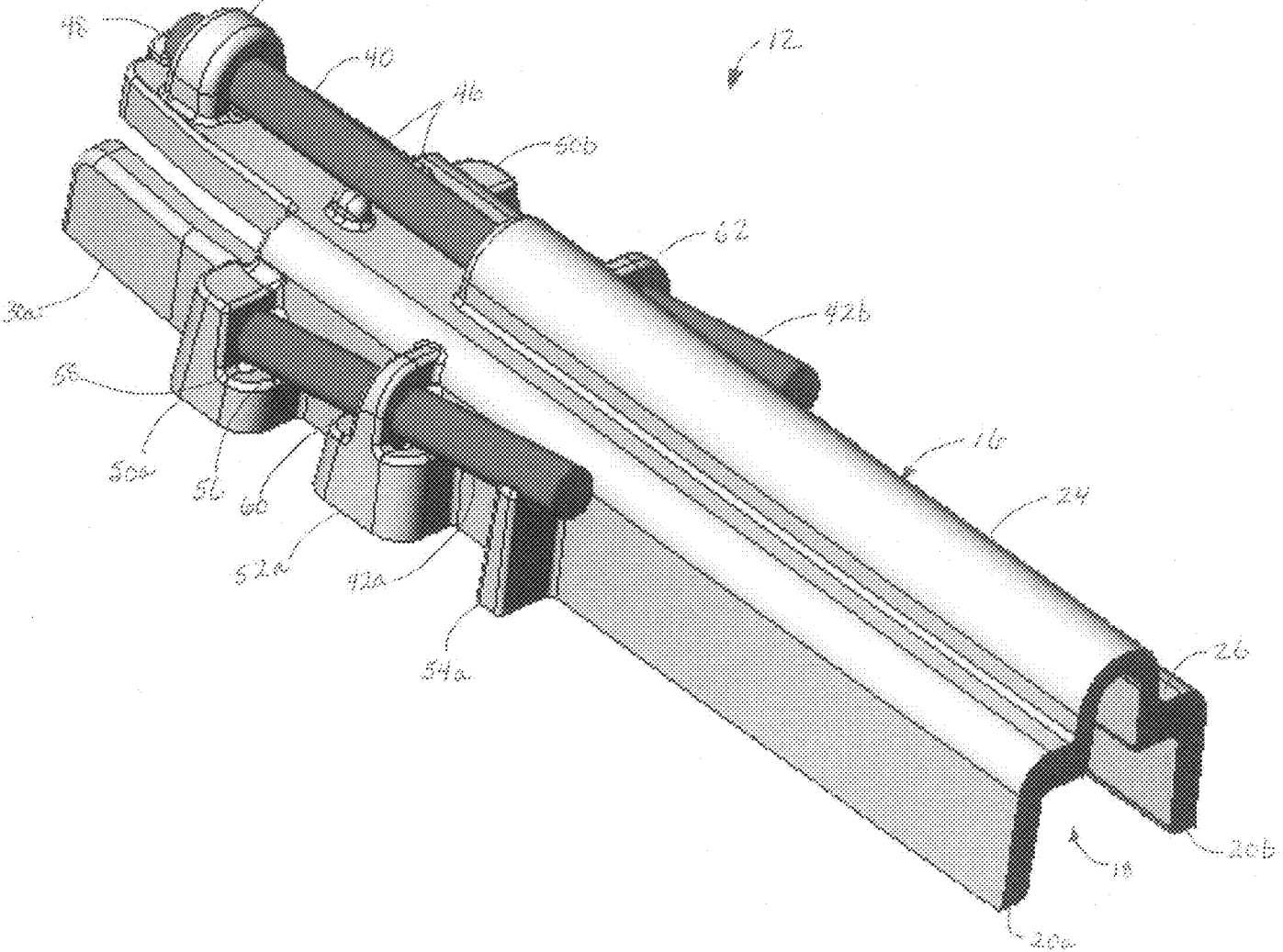
FIG. 11 is a transverse, cross-sectional view of the forward portion of the sighting apparatus of FIGS. 5-9, showing in greater detail the mounting channel and centerline sight passage of the housing of the apparatus.
Figure 12:
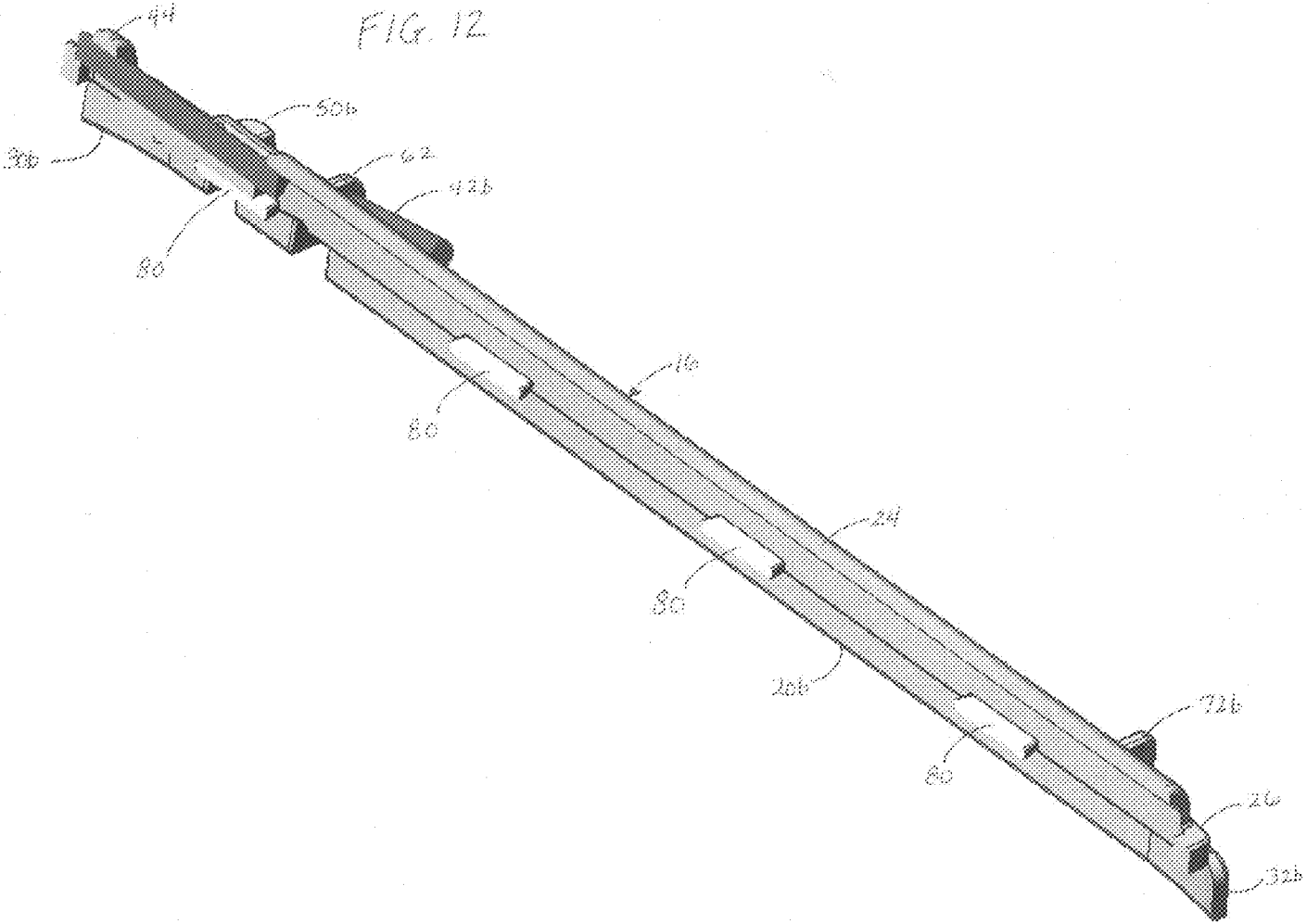
FIG. 12 is a perspective, longitudinal cross-sectional view of the sighting apparatus of FIGS. 5-9, showing in greater detail the relationship of the centerline optic fiber rod to the cooperating sight passage of the housing, and also the plurality of recessed magnets at the top of the mounting channel of the housing.
Figure 13:
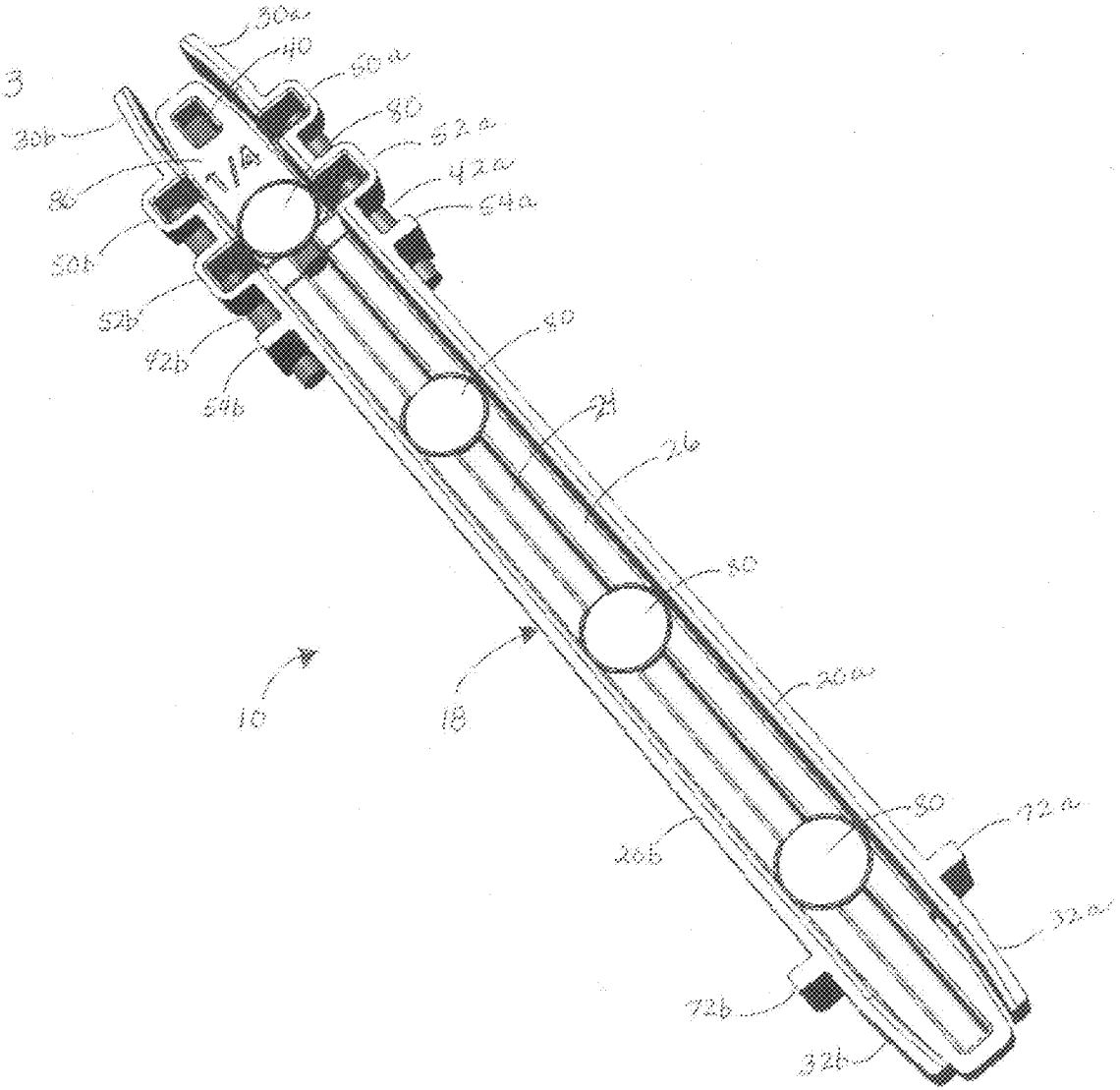
FIG. 13 is a bottom perspective view of the sighting apparatus of FIGS. 5-9, showing the structure of the housing in greater detail and also the positioning of the plurality of magnets within the mounting channel of the housing.
Figure 14:
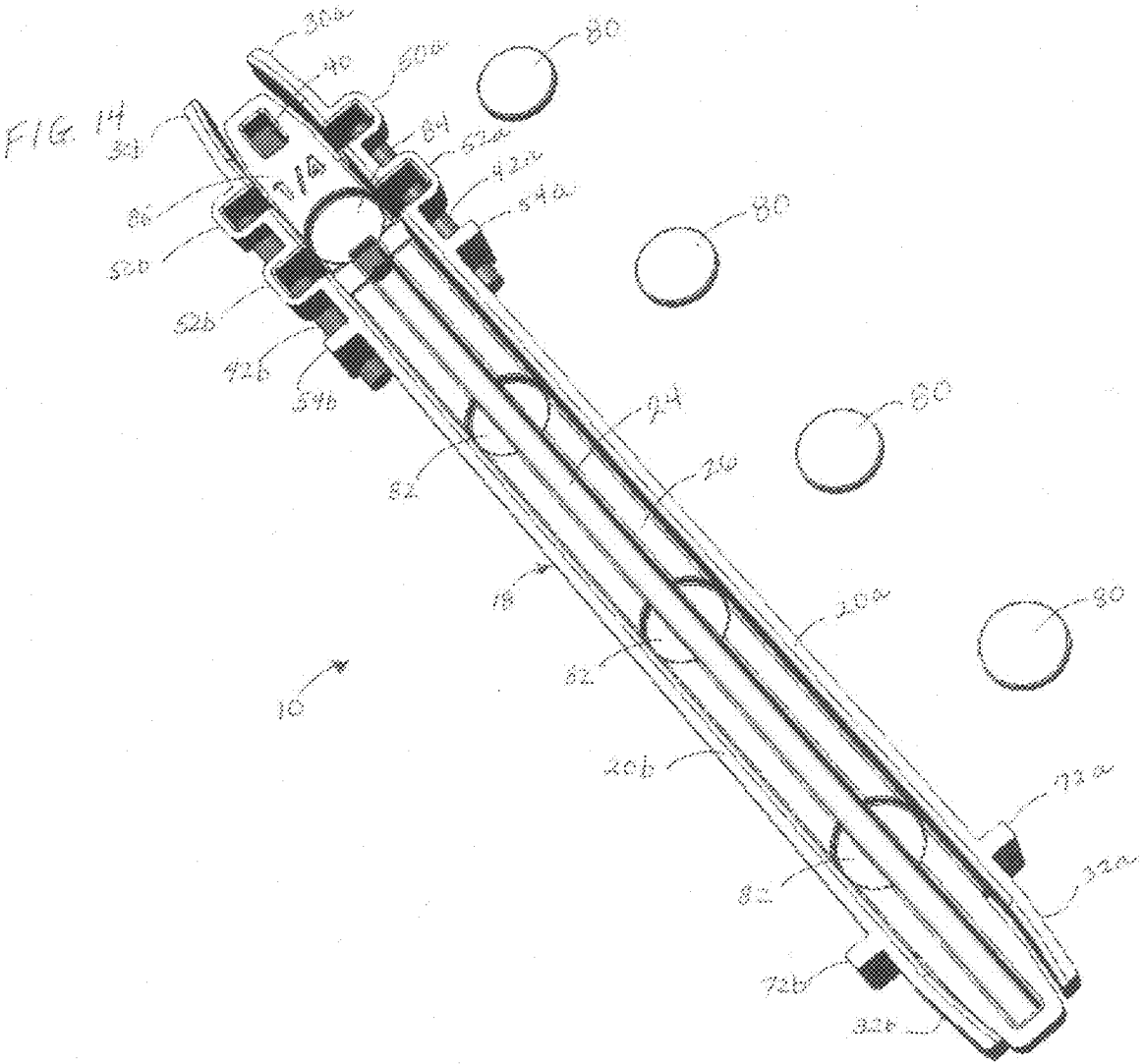
FIG. 14 is a bottom perspective, partially exploded view of the sighting apparatus of FIGS. 5-9, similar to FIG. 13, showing the recesses formed along the top wall of the mounting channel of the housing that receive the plurality of magnets therein.

As can also be seen in FIGS. 8 and 13-14, a legend 86 can optionally be provided in the bottom surface of wall 26, forward of sight passage 24, indicating the width of shotgun rib for which the assembly is intended; in the illustrated example, the width is indicated as ¼", which is a common size, and other widths can be indicated as appropriate. It will be understood that the location of the indicia, if provided, is somewhat arbitrary and can be placed in any suitable location.

Having described the structure of the aiming assembly 10, its operation and use will now be described with reference to FIGS. 15-24.

As noted above, FIG. 15 shows the sight picture seen by the shooter's aiming eye when held in the correct position, i.e., level and in longitudinal alignment with the top of the rib of the shotgun. In this position, the full circular shape of the "dot" formed by the rearward end of the centerline optical rod 40 can be seen by the aiming eye, through the rear aperture 76 of centerline sight passage 24; since the optical rod has an external diameter generally matching the internal diameter of sight passage 24, with the rearward end of the rod being inserted into the forward end of the passage, the "dot" appears precisely centered in the aperture. As noted above, the centerline rod is preferably green in color, and the "dot" at its ends appears "illuminated" due to the light-gathering and fluorescent qualities of the optic rod, so that the shooter perceives via the aiming eye a bright and clear impression of "go" indicating of correct sight alignment.

However, should the shooter inadvertently begin to raise his head and therefore his aiming eye above the level of the rib, which as discussed above is a very common tendency, the increased height causes the top portions 68 of the outboard optical rods 42*a*, 42*b* to become visible over the top edges 70 of the blinders 72*a*, 72*b*. As noted above, the outboard optical rods are preferably red/orange in color (or have some other color that contrasts with that of the centerline rod 40), so that their appearance is perceived as a visual warning to the shooter that the sight picture is or is becoming incorrect. Simultaneously, the raised height causes the aiming eye to move out of coaxial alignment with the centerline sight passage 24, so that the disk or "dot" presented by the end of the centerline rod 40 becomes partially obscured by the edge of aperture 76. The result is a perceptical diminution of the size and brightness of the green centerline "dot" indicating "go" accompanied by a corresponding increase in size/brightness of the red/orange outboard "dots" Indicating "stop", which in combination drives a profound visual warning to the shooter. The assembly thus provides a positive signal of proper aiming eye alignment, and a clear negative signal for even a very slight misalignment that may occur, for example, during the split second of trigger-pull.

Figure 17:
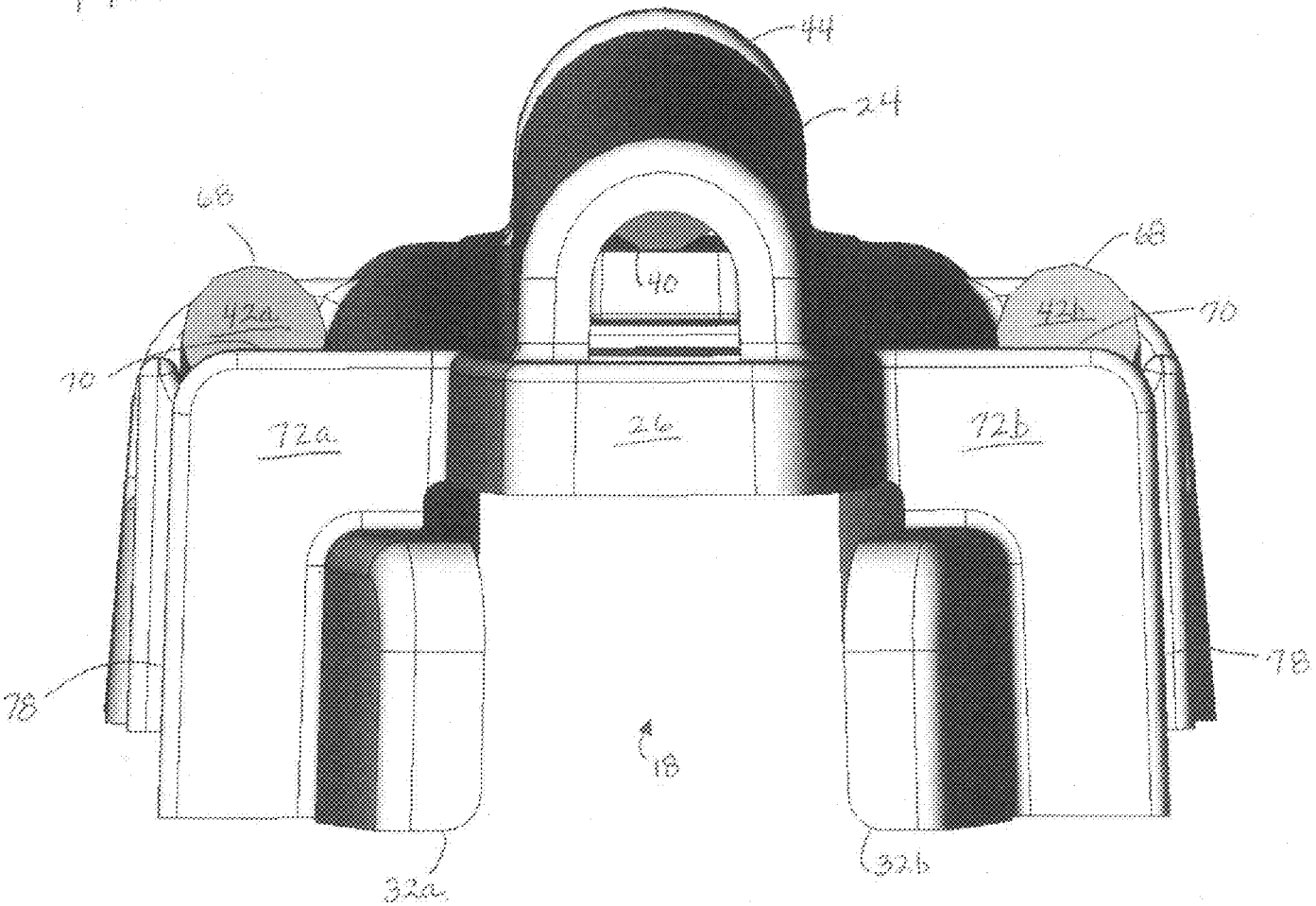
Figure 18:
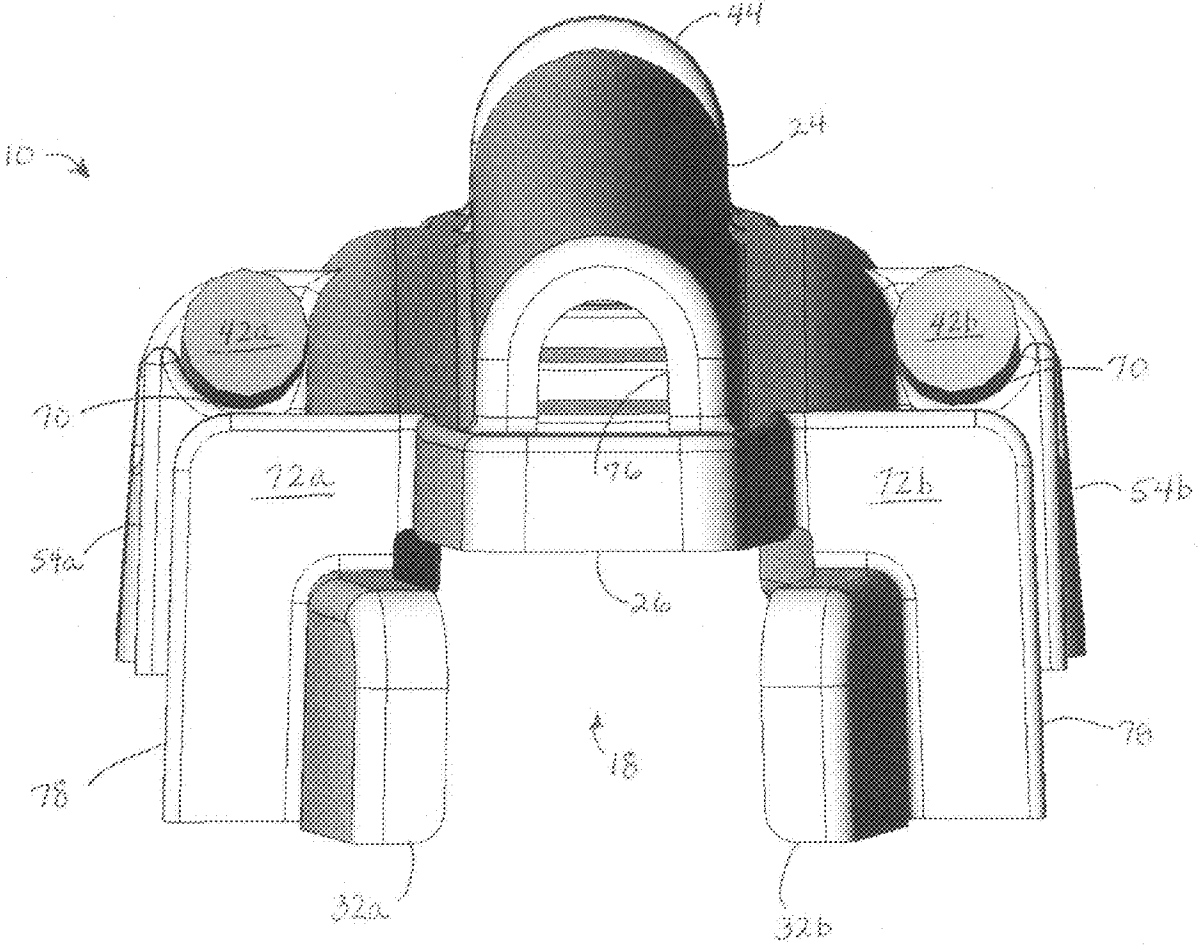

As can be seen in FIGS. 17-18, the effect described in the preceding paragraph becomes increasingly pronounced as the head/aiming eye moves further and further above the rib. The green centerline "dot" becomes increasing obscured and more and more of the red outboard "dots" emerge above blinders 72*a*, 72*b* (see FIG. 17), until ultimately the complete disks of the red "dots" formed by the ends of the outboard rods 42*a*, 42*b* are fully visible and the green "dot" formed by the centerline rod can no longer be seen at all (FIG. 18). Although presented as a sequence of views in FIGS. 15-18, it will be understood that in actuality the change in the sight picture seen by the aiming eye occurs more-or-less over a continuum, from viewing one green "dot" to two red "dots" and back as the head is alternately raised and lowered, so that with only a little practice leads to the shooter instinctively and naturally lowering his head to keep the aiming eye at the correct level, even over the course of a relatively rapid series of shots.

Figure 19:
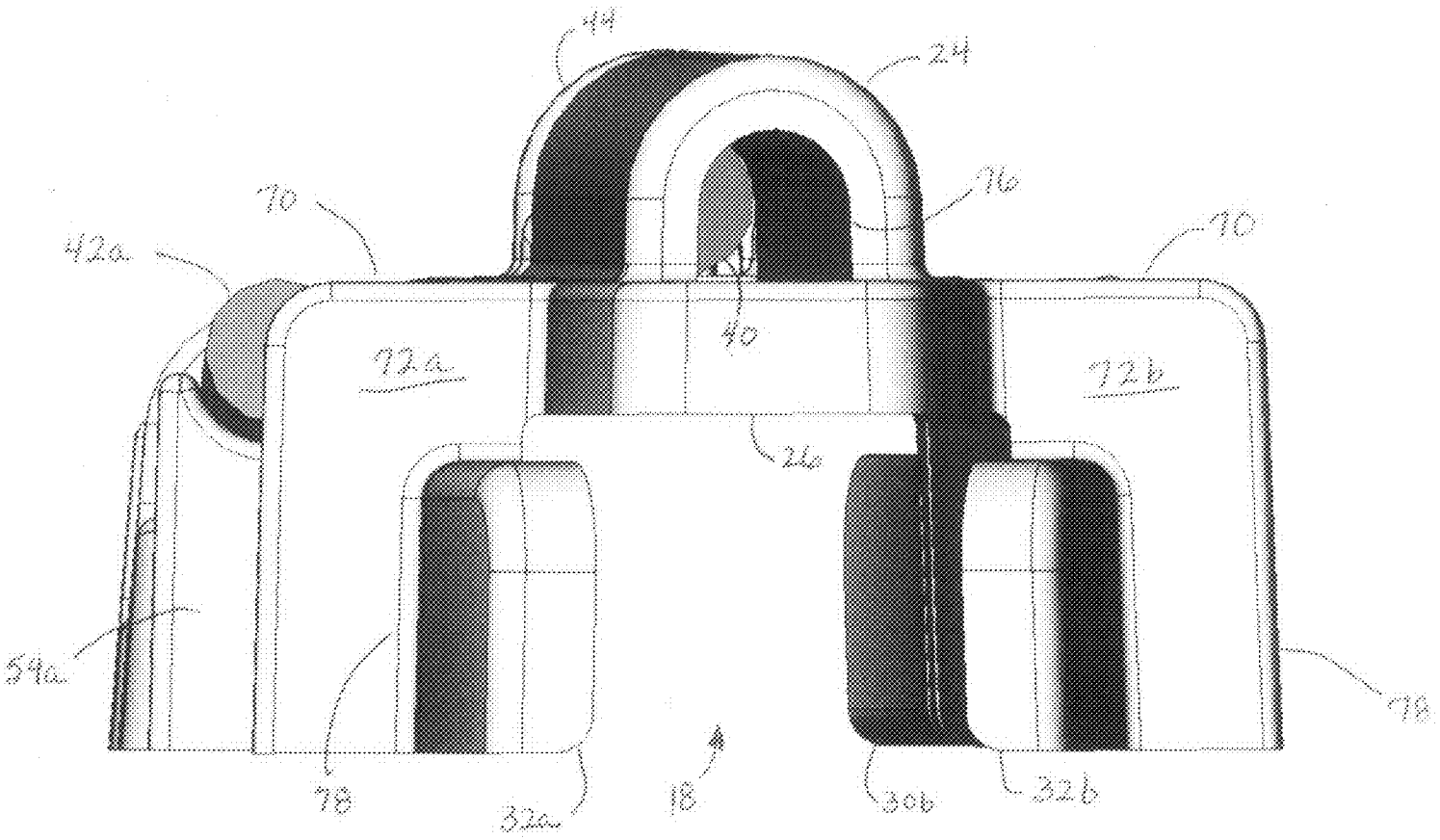
FIGS. 19-20 are sequential, rear elevational views of the sighting apparatus of FIGS. 5-9, similar to FIG. 15, showing the manner in which the outboard optic fiber rod of the left-side warning sight element becomes progressively more visible from behind the corresponding blinder portion at the rear of the housing as the aiming eye is incorrectly shifted by increased distances to the left of the rib of the shotgun.
Figure 20:
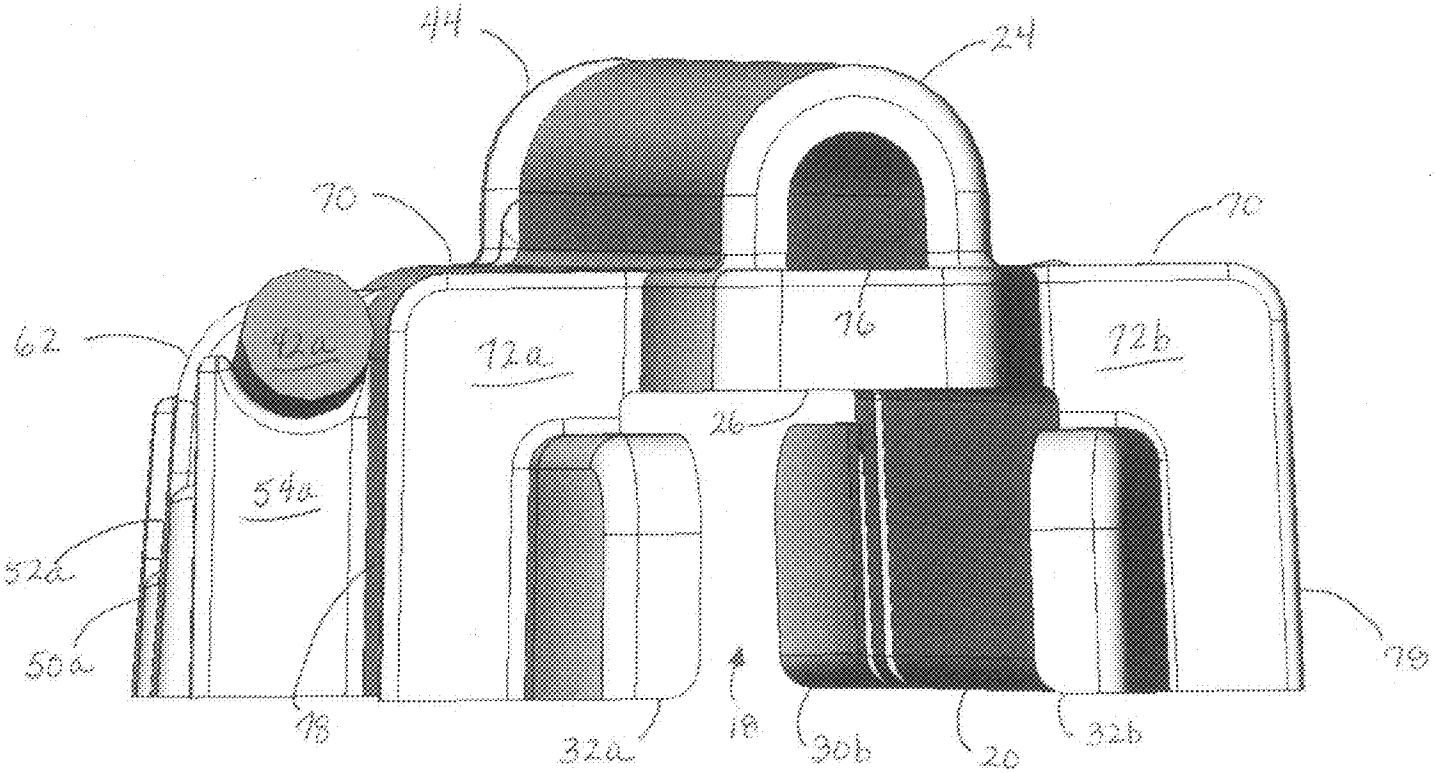
Figure 21:
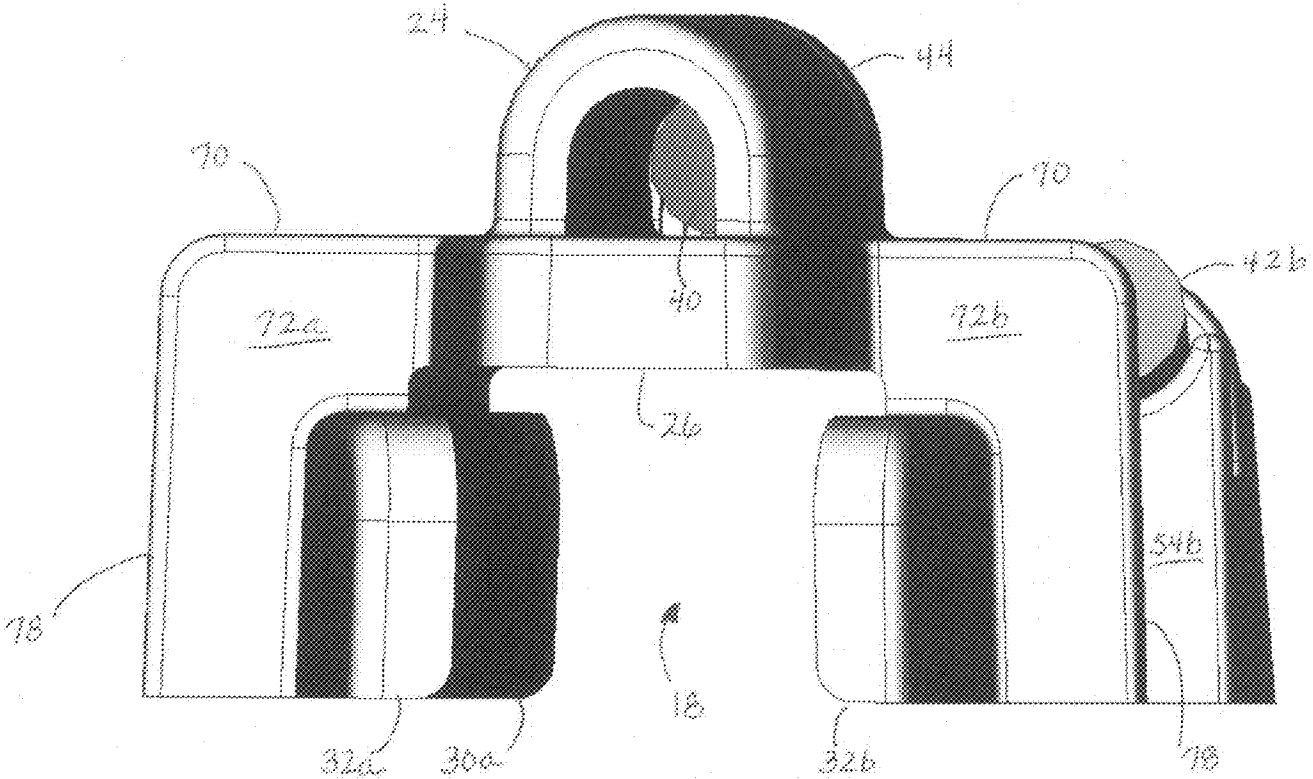
FIGS. 21-22 are sequential rear elevational views of the sighting apparatus of FIGS. 5-9, similar to FIG. 15, showing the manner in which the outboard optic fiber rod of the right-side warning sight element becomes progressively more visible from behind the corresponding blinder portion at the rear of the housing as the aiming eye is incorrectly shifted by increased distances to the right of the rib of the shotgun.
Figure 22:
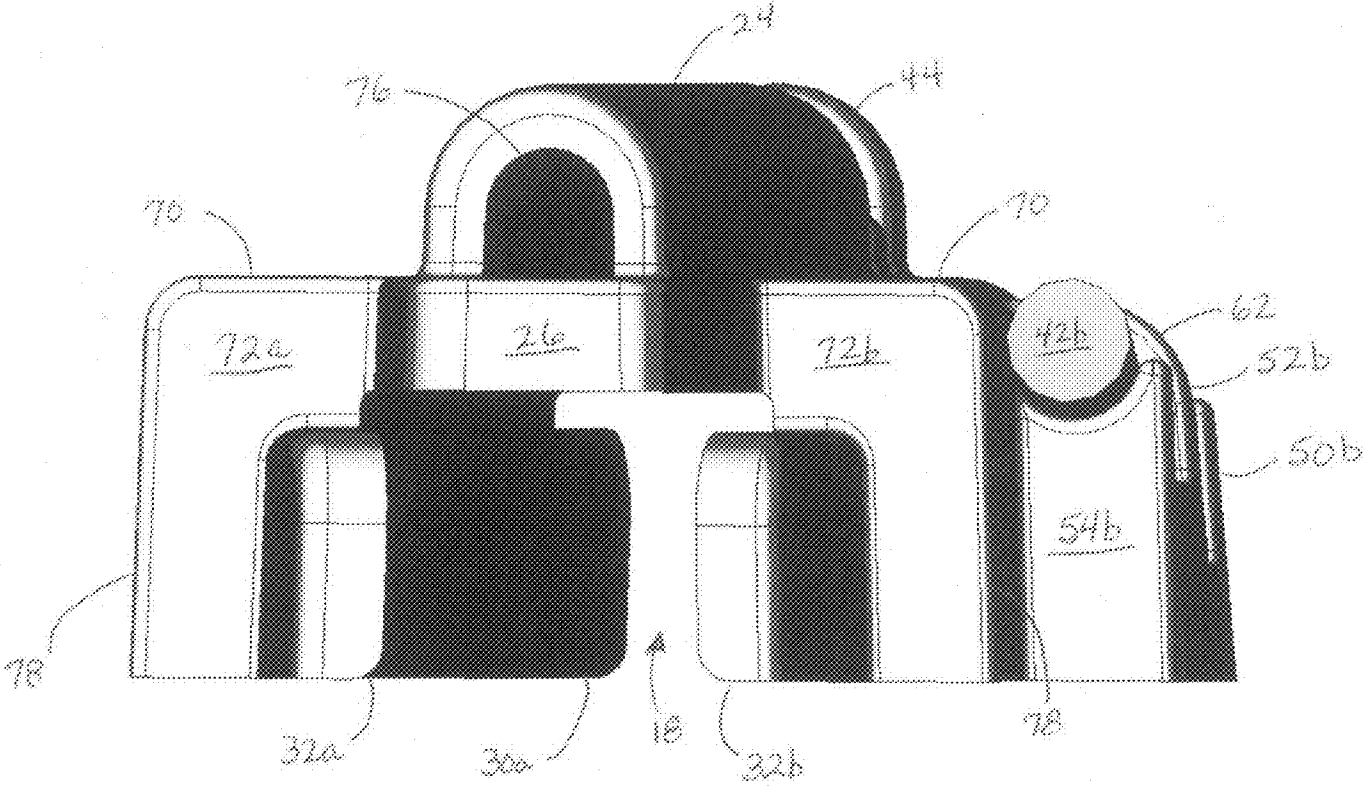

In addition to preventing the shooter from raising his head above the correct level, the sight assembly also functions to help maintain the aiming eye in the correct alignment side-to-side, thereby helping to avoid shooting to the side or behind or in front of the target. For example, FIGS. 19-20 show the image viewed by the aiming eye as it is shifted an increasing distance to the left of axial alignment with the rib, while FIGS. 21-22 show the corresponding views as the eye is shifted increasingly to the right. As can be seen in FIG. 19, when the aiming eye begins to shift to the left of the rib, the green "dot" formed by the end of the centerline rod 40 becomes partially obstructed by the left side of aperture 76, while the red/orange "dot" formed by the end of the left outboard rod 42*a* begins to emerge from behind the depending outer edge 78 of the left blinder portion 72*a*. With further leftward movement of the aiming eye, the end of the centerline optical rod becomes completely obscured in the sight passage 24 so that to the aiming eye it is no longer visible at all through aperture 76, while the full disk of the red/orange "dot" formed by the end of outboard rod 42*a* emerges from behind the outer edge 78 of blinder portion 72*a*. The same general sequence occurs as the aiming eye moves to the right of the rib, as shown in FIGS. 21-22, as the red "dot" formed by the end of the right outboard optic rod 42*b* emerges progressively from the outer edge 78 of the right blinder portion 72*b*.

Similar to the situation described above with respect to the head/aiming eye being elevated above the rib, side-to-side motion of the aiming eye causes the sight picture to change more-or-less along a continuum, with the green centerline "dot" becoming dimmer and the red/orange "dot" on the corresponding outboard side become progressively brighter as the eye moves further out of alignment, and vice versa. As a result, maintaining correct lateral alignment of the aiming eye can soon become almost automatic, after only a little time practicing with the sight assembly.

Figure 23:
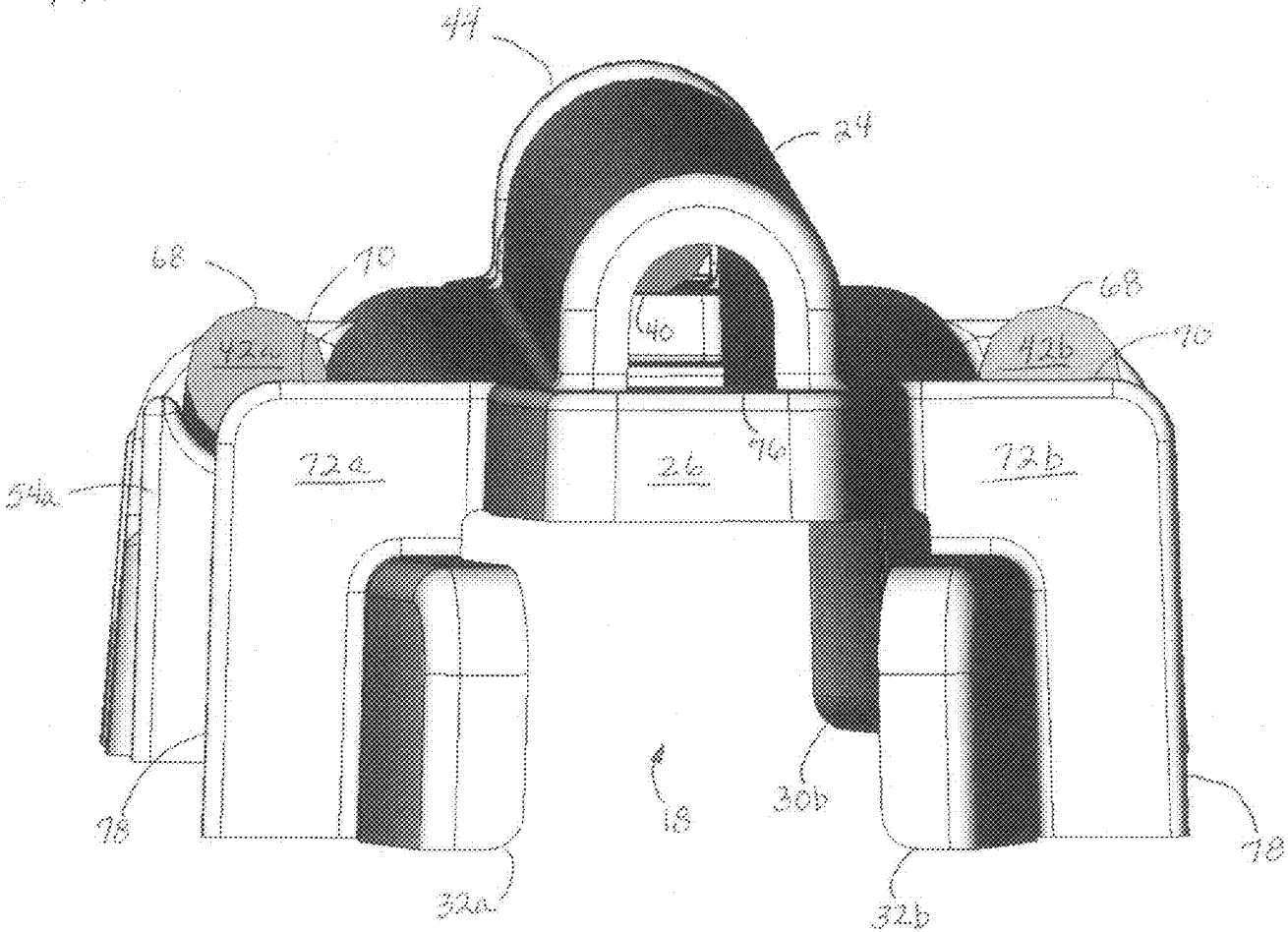
FIG. 23 is a rear elevational view of the sighting apparatus of FIGS. 5-9, similar to FIG. 15, showing the manner in which the optic fiber rods of the aiming and warning sight elements become visible to the aiming eye in a differentiated matter as the aiming eye is incorrectly raised above and shifted to the left of the rib of the shotgun.
Figure 24:
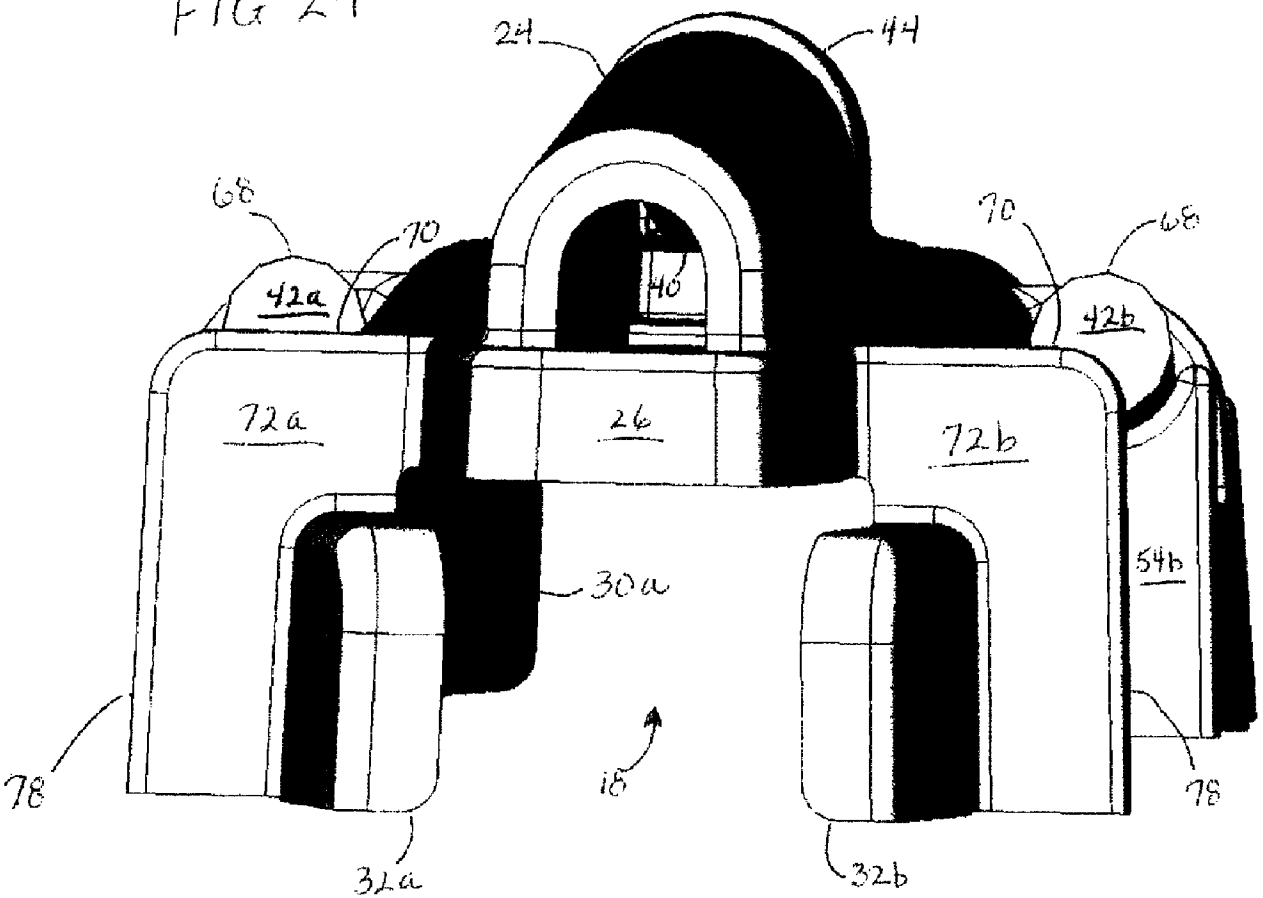
FIG. 24 is a rear elevational view of the sighting apparatus of FIGS. 5-9, similar to FIG. 15, showing the manner in which the optic fiber rods of the aiming and warning sight elements become visible to the aiming eye in a differentiated matter as the aiming eye is incorrectly raised above and shifted to the right of the rib of the shotgun.

FIGS. 23-24 illustrate the effect on the sight picture of incorrectly moving the aiming eye a combination of both above and to the side of the rib. As can be seen in FIG. 23, when the eye is raised and shifted to the left, the green "dot" presented by the centerline optic rod 40 becomes partially obscured in the upper left part of aperture 76, while simultaneously the greater part of the red "dot" formed by the end of left outboard rod 42*a* emerges both above and to the side of the upper and outer edges 70, 78 of blinder portion 72*a* and the upper portion of the red/orange "dot" appears above the upper edge 70 of the right side blinder portion 72*b*. The biggest red/orange "dot" in the sight picture is therefore that on the side to which the eye has been shifted providing a warning prompting the shooter to move the eye back to the right (in this case) and downwardly until the red/orange "dots" disappear and the full green "dot" appears through aperture 76. Likewise, the corresponding sight picture presented in FIG. 24 prompts the shooter to move the aiming eye back left and downward so as to be correctly aligned with the rib.

In addition to illustrating the sight picture seen by the aiming eye when raised above and to the side of the rib, the views in FIGS. 19-24 also to a greater or lesser extent correspond to the views seen by the shooter's non-aiming eye, i.e., the left eye in FIG. 23 and the right eye in FIG. 24. As noted above, cross-dominance by the non-aiming eye is a common and significant problem with conventional shotgun sights, since a typical bead appears very much the same from the viewpoint of both aiming and non-aiming eyes, and this can lead to the shotgun being pointed high and to one side or the other. With the sight assembly of the present invention, however, the sight picture seen by the non-aiming eye is distinctly different and easily distinguishable from that seen by the aiming eye: When properly aligned, the sight picture seen by the aiming eye is that of FIG. 15, in which only the green "dot" of the centerline optic rod visible, while the view of the non-aiming eye is similar to that of FIGS. 19-24 depending on the angle of the head, with the green "dot" largely or wholly obscured and the red/orange warning "dots" of one or both the outboard rods being distinctly visible. The ease with which the monocular image of the non-aiming eye can be suppressed is enhanced not only by the dissimilarity of the conflicting monocular stimuli per se, but also the relative complexity of the image perceived via the non-aiming eye, which assists the brain in rapidly distinguishing between the two stimuli. Therefore, all that is needed for the shooter to avoid the problem of cross-dominance is to concentrate on the green "dot" seen by the aiming eye, causing the impression of the non-aiming eye to be ignored, and again this can become almost instinctual with a short period of practice.

Figure 25:
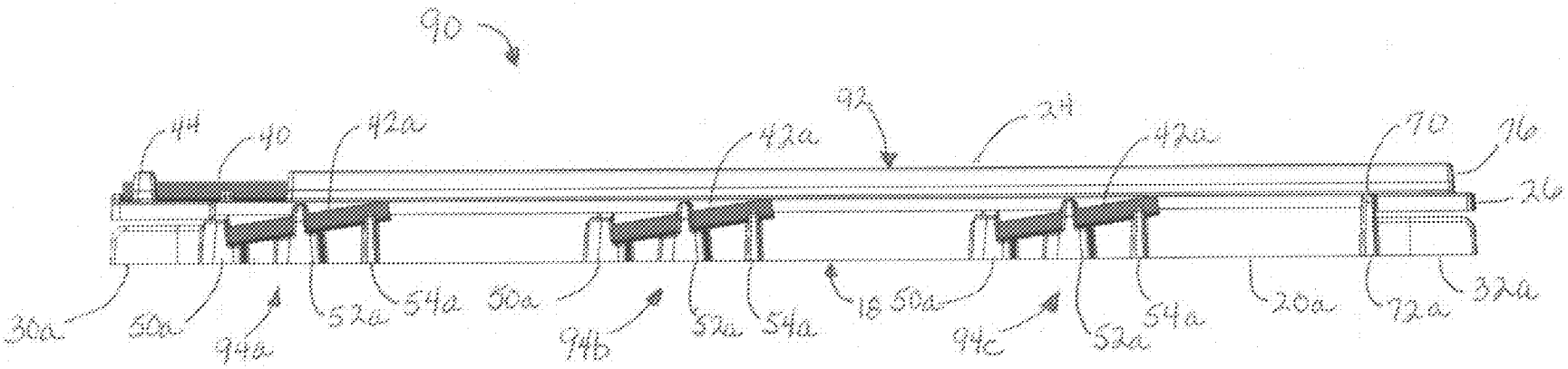
FIG. 25 is a side elevational view of a sighting apparatus in accordance with another embodiment of the invention, having multiple sets of warning sight elements mounted at longitudinally spaced locations.

In the embodiment described above, there is a single set of warning sight elements, located so as to be mounted near the muzzle end of the rib. In some embodiments, however, there may be multiple sets of warning sight elements and/or blinders, positioned to be at spaced apart locations along part or all of length of the rib, so that multiple warning images are seen by the aiming eye if raised above and/or moved laterally out of proper alignment. For example, FIG. 25 shows an aiming apparatus 90 similar to that described above, but having a longer housing 92 with a correspondingly elongated channel portion, sight passage, and so on. However, rather than a single set of warning sight elements, multiple sets of warning sight elements 94*a*, 94*b*, 94*c* are mounted on opposite sides to the depending walls of the elongate channel portion. As can be seen, each set of warning sight elements includes optic fiber rods 42*a-b* mounted on supports 50*a-b*, 52*a-b*. 54*a-b* (the left side only being visible in FIG. 25) in the manner described above, so that the rearward ends of the rods are below the level of the upper surface of the top wall 26 of the channel portion and the upper edges 70 of the blinders 72*a-b*. As with the embodiment described above, the rearward ends of the rods of the warning sight elements are also positioned inwardly of the outer edges of blinders 72*a-b*. Accordingly, when the aiming eye is lifted above and/or shifted to the side, out of proper alignment with the rib having the assembly 90 mounted thereto, a series of red/orange "dots" created by the rearward ends of the multiple sets of rods becomes visible above and/or to the side of the blinders 72*a-b*, similar to the situation with the embodiment described above but with the combined effect of the multiple elements providing an even brighter and more dramatic visual warning. Likewise, a cross-dominant non-aiming eye will also perceive multiple warning elements. It will be understood that some embodiments may include fewer or more sets of warning sight elements, and may include a single set of blinders as shown or multiple sets of blinders matched with the sets of warning sight elements. Moreover, rather than a single housing, separate housing pieces, or other structures or fixtures may be used for mounting the various sight elements in groups or individually along the rib of the shotgun.

In short, sight passage and dividers of the sight assembly 10 act in concert to alternately open and mask the centerline aiming sight element and outboard warning sight element to view by the aiming eye depending on whether the aiming eye is in correct alignment with the rib or incorrectly raised or moved to either side thereof. The use of optic fiber rods for both elements provides an exceptionally bright and effective display/sight picture, however it will be understood that other materials or components may be used to form the aiming and/or warning sight elements. For example, in some embodiments other members may be employed in place of or in conjunction with the centerline optic rod, such as the lenticular bead shown in FIG. 19 of U.S. Pat. No. 6,604,315, for example. Furthermore, some embodiments may utilize a pre-installed or original equipment bead as the centerline sighting elements, with or without an associated sight passage.

It will also be understood that the size, shape, and other aspects of the structures themselves may vary somewhat from the preferred embodiment that is illustrated, so long as they perform the requisite functions. For example, in some embodiments the sight channel may not extend the full length of the housing, or the blinder portions may have shapes other than the flat, panel-like lateral extensions that are shown in the figures.

It is therefore to be recognized that these and various other alterations, modifications, and/or additions may be introduced into the constructions and arrangements of parts described above without departing from the spirit or ambit of the present invention as defined by the appended claims.

What is claimed is:

1. An aiming apparatus for a shotgun, said aiming apparatus comprising:

a housing that is mountable to a rib of a shotgun;

at least one warning sight element mounted to said housing so as to be positioned generally below and offset to a side of an upper surface of said rib; and at least one blinder portion mounted on said housing so that an upper edge of said blinder portion is positioned rearwardly of said at least one warning sight element and generally level with said upper surface of said rib;

so that said warning sight element is obscured by said upper edge of said blinder portion from view by an aiming eye when said aiming eye is in a correct position substantially level with said upper surface of said rib, and is at least partially visible above said upper edge of said blinder portion when said aiming eye is in an incorrect position elevated above said upper surface of said rib.

2. The aiming apparatus of claim 1, wherein said at least one warning sight element comprises:

first and second said warning sight elements mounted to said housing so as to be positioned generally below and offset to opposite sides of said upper surface of said rib.

3. The aiming apparatus of claim 2, wherein said at least one blinder portion comprises:

first and second said blinder portions mounted on said housing so that upper edges of said blinder portions are positioned rearwardly of said first and second warning sight elements on opposite sides of said upper surface of said rib.

4. The aiming apparatus of claim 3, wherein said first and second warning sight elements comprise:

a single set of said warning sight elements for being mounted at a location towards a muzzle end of said rib of said shotgun.

5. The aiming apparatus of claim 4, wherein said first and second warning sight elements comprise:

a plurality of sets of said warning sight elements for being mounted at spaced apart locations along said rib of said shotgun.

6. The aiming apparatus of claim 3, further comprising:

an aiming sight element mounted to said housing intermediate said first and second warning sight elements so as to be positioned generally level and in longitudinal alignment with said upper surface of said rib.

7. The aiming apparatus of claim 6, further comprising:

a sight passage mounted on said housing so that an opening of said sight portion is positioned rearwardly of said aiming element and generally level with an in centerline alignment with said upper surface of said rib;

so that said aiming sight element is visible to said opening of said sight passage by said aiming eye when said aiming eye is in said correct position substantially level with said upper surface of said rib, and is at least partially obscured by an upper edge of said opening of said sight passage when said aiming eye is in an incorrect position elevated above said upper surface of said rib.

8. The aiming apparatus of claim 7, wherein said sight passage comprises:

an elongate passage extending on said sight element proximate a forward end of said housing to said opening proximate a rearward end of said housing.

9. The apparatus of claim 3, wherein said first and second blinder portions each further comprise:

outer edges that are positioned rearwardly and outwardly of said first and second warning sight elements;

so that said warning sight elements are obscured by said outer edges of said blinder portions from view by said aiming eye when said aiming eye is in a correct position substantially in alignment with a longitudinal centerline of said rib, and are at least partially visible outside said outer edges of said blinder portions when said aiming eye is in incorrect positions offset from said longitudinal centerline of said rib.

10. The aiming apparatus of claim 3, wherein said warning sight elements each comprise:

a rod of light-gathering optic fiber.

11. The aiming apparatus of claim 6, wherein said warning sight elements each comprise:

a rod of light-gathering optic fiber.

12. The aiming apparatus of claim 11, wherein said aiming sight element comprises:

a rod formed of light-gathering optic fiber.

13. The aiming apparatus of claim 12, further comprising:

means for mounting said rod of said aiming sight element substantially level and in longitudinal alignment with said upper surface of said rib of said shotgun, so that said rod of said aiming sight element is viewed substantially in end-on alignment by said aiming eye when in said correct position substantially level with said upper surface of said rib.

14. The aiming apparatus of claim 12, further comprising:

means for mounting said rods said first and second warning sight elements at an upward angle towards said rearward end of said housing, so that said rods of said warning sight elements are viewed substantially in end-on alignment by said aiming when in said incorrect position elevated above said upper surface of said rib.

15. The aiming apparatus of claim 11, wherein said optic fiber material of said aiming sight element is an optic fiber having a first color, and said optic fiber of said warning sight elements is a fiber optic having a second color that provides a visual contrast with said first color.

16. The aiming apparatus of claim 15, wherein said first color is a color having a substantially green hue and said second color is a color having a substantially red hue.

17. The aiming apparatus of claim 6, wherein said housing comprises:

means for attaching said housing to said rib of a shotgun.

18. The aiming apparatus of claim 17, wherein said means for attaching said housing to said rib of a shotgun comprises:

a channel portion having first and second depending, generally parallel walls spaced apart to receive said rib in close-fitting engagement therewith, and an upper wall that spans said depending walls to contact said upper surface of said rib.

19. The aiming apparatus of claim 18, wherein said means for attaching said housing to said rib of a shotgun further comprises:

first and second pairs of inwardly-biased finger portions that project from forward and rearward ends of said depending sidewalls for pressing against sides of said rib so as to establish a grip thereon.

20. The aiming apparatus of claim 18, wherein said means for attaching said housing to said rib of a shotgun further comprises:

at least one magnet mounted to said upper wall of said channel portion for establishing a magnetic engagement with said rib.

21. An aiming apparatus for a shotgun, said aiming apparatus comprising:

an elongate housing that is mountable to a rib of a shotgun, said housing comprising:

a channel portion for attachment to said rib of a shotgun, said channel portion comprising:

first and second depending, substantially parallel sidewalls that are spaced apart to form a gap sized to receive said rib of a shotgun in close-fitting engagement therewith, said depending walls being shorter in height than a height of said rib;

an upper wall that spans said depending sidewalls for contacting an upper surface of said rib;

first and second pairs of opposed, inwardly-biased finger portions that extend from ends of said depending sidewalls for pressing against sides of said rib so as to establish a grip thereon; and at least one magnet that is mounted to said upper wall of the channel portion for establishing a magnetic engagement with said rib when said upper wall is in contact therewith;

a sight passage that is located atop said upper wall of said channel portion, said sight passage comprising:

an elongate, substantially enclosed passage extending along a centerline of said upper wall so as to be positioned generally proximate to and in longitudinal alignment with said upper surface of said rib of said shotgun when said assembly is mounted on said rib;

a coaxial opening at a forward end of said enclosed passage; and a coaxial aperture at a rearward end of said enclosed passage through which said opening at said forward end of said passage can be viewed by an aiming eye; and first and second blinder portions that extend laterally from said depending sidewalls of said channel portion on opposite sides of said housing, said blinder portions each comprising:

an outwardly extending panel have an upper edge that is substantially level with a lower edge of said aperture and a depending outer edge that is spaced outwardly from an outer surface of said depending wall of said channel portion; and a plurality of sight elements located proximate a forward end of said sight assembly, said plurality of sight elements comprising:

an aiming sight element formed of a rod of light-collecting optic fiber having a first color, said aiming sight element being mounted atop said upper wall of said channel portion forward of and in coaxial alignment with said enclosed sight passage, a rearward end of said rod of said aiming sight member being received in said opening at said forward end of said enclosed sight passage; and first and second warning sight elements formed of rods of optic fiber having a second color that forms a visual contrast with said first color, said warning sight members being mounted to said outer surfaces of said depending walls on opposite sides of said channel portion, said rods of said warning sight elements being mounted substantially parallel to said centerline and angle extending upwardly towards said rearward end of said housing, rearward ends of said rods of said warning sight elements being positioned below said upper edges of said panels of said blinder portions and inboard of said outer edges of said panels;

so that said rearward end of said aiming sight element is visible through said aperture of said sight passage by an aiming eye when said aiming eye is in a correct position substantially level and in longitudinal alignment with said upper surface of said rib of a shotgun, and is at least partially obscured by an edge of said aperture of said sight passage when said aiming eye is in an incorrect position elevated above or offset laterally from said upper surface of said rib; and so that said rearward ends of said warning sight elements are obscured behind said upper and outer edges of said panels of said blinder portions from view by said aiming eye when said aiming eye is in said correct position substantially level and in longitudinal alignment with said upper surface of said rib of said shotgun, and are at least partially visible above or beside said upper and outer edges of said panels of said blinder portions when said aiming eye is in an incorrect position elevated above or laterally offset from said upper surface of said rib.

22. An aiming apparatus for a shotgun, said aiming apparatus comprising:

a housing that is mountable to a rib of a shotgun;

first and second said warning sight elements mounted to said housing so as to be positioned generally below and offset to opposite sides of an upper surface of said rib, said warning sight elements each comprising a rod of light-gathering optic fiber; and at least one blinder portion mounted on said housing so that an upper edge of said blinder portion is positioned rearwardly of said at least one warning sight element and generally level with said upper surface of said rib;

so that said warning sight element is obscured by said upper edge of said blinder portion from view by an aiming eye when said aiming eye is in a correct position substantially level with said upper surface of said rib, and is at least partially visible above said upper edge of said blinder portion when said aiming eye is in an incorrect position elevated above said upper surface of said rib.

23. The aiming apparatus of claim 22, further comprising:

an aiming sight element mounted to said housing intermediate said first and second warning sight elements so as to be positioned generally level and in longitudinal alignment with said upper surface of said rib.

24. The aiming apparatus of claim 23, wherein said aiming sight element comprises:

a rod formed of light-gathering optic fiber.

25. The aiming apparatus of claim 24, further comprising:

means for mounting said rod of said aiming sight element substantially level and in longitudinal alignment with said upper surface of said rib of said shotgun, so that said rod of said aiming sight element is viewed substantially in end-on alignment by said aiming eye when in said correct position substantially level with said upper surface of said rib.

26. The aiming apparatus of claim 24, further comprising:

means for mounting said rods said first and second warning sight elements at an upward angle towards said rearward end of said housing, so that said rods of said warning sight elements are viewed substantially in end-on alignment by said aiming when in said incorrect position elevated above said upper surface of said rib.

27. The aiming apparatus of claim 24, wherein said optic fiber material of said aiming sight element is an optic fiber having a first color, and said optic fiber of said warning sight elements is a fiber optic having a second color that provides a visual contrast with said first color.

28. The aiming apparatus of claim 27, wherein said first color is a color having a substantially green hue and said second color is a color having a substantially red hue.

29. An aiming apparatus for a shotgun, said aiming apparatus comprising:

a housing that is mountable to a rib of a shotgun, said housing comprising:

means for attaching said housing to said rib of a shotgun;

said means for attaching said housing to said rib of a shotgun comprising:

a channel portion having first and second depending, generally parallel walls spaced apart to receive said rib in close-fitting engagement therewith, and an upper wall that spans said depending walls to contact said upper surface of said rib;

first and second warning sight elements mounted to said housing so as to be positioned generally below and offset to opposite sides of an upper surface of said rib;

an aiming sight element mounted to said housing intermediate said first and second warning sight elements so as to be positioned generally level and in longitudinal alignment with said upper surface of said rib; and at least one blinder portion mounted on said housing so that an upper edge of said blinder portion is positioned rearwardly of said at least one warning sight element and generally level with said upper surface of said rib, said at least one blinder portion comprising:

first and second said blinder portions mounted on said housing so that upper edges of said blinder portions are positioned rearwardly of said first and second warning sight elements on opposite sides of said upper surface of said rib;

so that said warning sight element is obscured by said upper edge of said blinder portion from view by an aiming eye when said aiming eye is in a correct position substantially level with said upper surface of said rib, and is at least partially visible above said upper edge of said blinder portion when said aiming eye is in an incorrect position elevated above said upper surface of said rib.

30. The aiming apparatus of claim 29, wherein said means for attaching said housing to said rib of a shotgun further comprises:

first and second pairs of inwardly-biased finger portions that project from forward and rearward ends of said depending sidewalls for pressing against sides of said rib so as to establish a grip thereon.

31. The aiming apparatus of claim 29, wherein said means for attaching said housing to said rib of a shotgun further comprises:

at least one magnet mounted to said upper wall of said channel portion for establishing a magnetic engagement with said rib.

32. An aiming apparatus for a shotgun, said aiming apparatus comprising:

at least one warning sight element mounted on said shotgun so as to be positioned generally below and offset to a side of an upper surface of a rib of said shotgun; and at least one blinder mounted on said shotgun so that an upper edge of said blinder is positioned rearwardly of said at least one warning sight element and generally level with said upper surface of said rib;

so that said warning sight element is obscured by said upper edge of said blinder from view by an aiming eye when said aiming eye is in a correct position substantially level with said upper surface of said rib, and is at least partially visible above said upper edge of said blinder when said aiming eye is in an incorrect position elevated above said upper surface of said rib.

33. The aiming apparatus of claim 32, wherein said at least one warning sight element comprises:

first and second said warning sight elements positioned generally below and offset to opposite sides of said upper surface of said rib.

34. The aiming apparatus of claim 33, wherein said at least one blinder comprises:

first and second said blinders mounted on said shotgun so that upper edges of said blinder portions are positioned rearwardly of said first and second warning sight elements on opposite sides of said upper surface of said rib.

35. The aiming apparatus of claim 34, further comprising:

an aiming sight element mounted on said shotgun intermediate said first and second warning sight elements so as to be positioned generally level and in longitudinal alignment with said upper surface of said rib.

* * * * *